US007922313B2

(12) United States Patent
McAvoy et al.

(10) Patent No.: US 7,922,313 B2
(45) **Date of Patent: *Apr. 12, 2011**

(54) PRINTHEAD WITH PRESSURE-DAMPENING STRUCTURES

(75) Inventors: Gregory John McAvoy, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 797 days.

This patent is subject to a terminal disclaimer.

(21) Appl. No.: 11/946,838

(22) Filed: Nov. 29, 2007

(65) Prior Publication Data

US 2009/0141109 A1 Jun. 4, 2009

(51) Int. Cl.
*B41J 2/17* (2006.01)

(52) U.S. Cl. ..... 347/94

(58) Field of Classification Search ..... 347/54, 347/56, 65, 66, 94

See application file for complete search history.

(56) References Cited

U.S. PATENT DOCUMENTS

| | | | | |
|---|---|---|---|---|
| 4,575,738 | A | 3/1986 | Sheufelt et al. | |
| 4,730,197 | A * | 3/1988 | Raman et al. | 347/40 |
| 5,030,973 | A | 7/1991 | Nonoyama et al. | |
| 5,880,748 | A | 3/1999 | Childers et al. | |
| 6,350,023 | B1 | 2/2002 | Silverbrook | |
| 6,450,619 | B1 * | 9/2002 | Anagnostopoulos et al. | 347/59 |
| 6,491,385 | B2 | 12/2002 | Anagnostopoulos et al. | |
| 7,004,574 | B2 | 2/2006 | Neese et al. | |
| 7,121,650 | B2 * | 10/2006 | Chung et al. | 347/68 |
| 7,241,000 | B2 * | 7/2007 | Hirota et al. | 347/85 |
| 7,347,522 | B2 | 3/2008 | Kubo | |
| 7,479,256 | B1 | 1/2009 | Gruhler et al. | |
| 7,802,874 | B2 * | 9/2010 | Wee et al. | 347/68 |
| 2002/0149654 | A1 | 10/2002 | Anagnostopoulos et al. | |
| 2007/0019042 | A1 | 1/2007 | Chung et al. | |
| 2007/0081044 | A1 | 4/2007 | Silverbrook | |
| 2009/0141108 | A1 * | 6/2009 | McAvoy et al. | 347/94 |

* cited by examiner

*Primary Examiner* — Anh T. N. Vo

(57) ABSTRACT

An inkjet printhead is provided. The printhead comprises a plurality of nozzle assemblies; a nozzle plate covering the plurality of nozzle assemblies; an ink supply system for supplying ink to the plurality of nozzle assemblies, the ink supply system comprising at least one conduit wall defined by part of the nozzle plate; and at least one pressure-dampening structure positioned in the part of the nozzle plate. The pressure-dampening structures dampen ink pressure fluctuations in the ink supply system.

19 Claims, 10 Drawing Sheets

PRINTHEAD WITH PRESSURE-DAMPENING STRUCTURES

FIELD OF THE INVENTION

The present invention relates to the field of printers and particularly inkjet printheads. It has been developed primarily to improve print quality and reliability in high resolution printheads.

CROSS REFERENCE TO OTHER RELATED APPLICATIONS

The following applications have been filed by the Applicant simultaneously with this application:

MNN031US MNN033US CPH009US

The disclosures of these co-pending applications are incorporated herein by reference. The above applications have been identified by their filing docket number, which will be substituted with the corresponding application number, once assigned.

The following patents or patent applications filed by the applicant or assignee of the present invention are hereby incorporated by cross-reference.

| | | | | | | |
|---|---|---|---|---|---|---|
| 11/159,193 | 10/510,098 | 11/124,256 | 10/760,248 | 10/949,288 | 10/509,999 | 10/902,883 |
| 11/601,670 | 10/636,211 | 10/944,043 | 09/575,172 | 11/006,734 | 10/509,997 | 09/575,172 |
| 11/255,942 | 10/503,929 | 10/470,942 | 11/063,577 | 11/149,389 | 09/517,384 | 10/666,495 |
| 10/636,214 | 10/656,469 | 11/228,410 | 11/758,644 | 11/003,418 | 11/003,334 | 11/003,700 |
| 11/003,684 | 11/003,617 | 11/097,266 | 11/097,267 | 11/499,746 | 11/501,774 | 11/545,501 |
| 11/084,237 | 11/084,240 | 11/084,238 | 11/446,240 | 11/442,381 | 11/764,729 | 10/683,041 |
| 10/922,875 | 10/922,880 | 10/922,881 | 10/922,876 | 11/124,200 | 11/155,544 | 11/038,200 |
| 11/209,709 | 11/330,058 | 10/510,092 | 10/510,207 | 10/534,823 | 10/534,804 | 10/534,883 |
| 11/246,685 | 10/760,238 | 10/760,231 | 11/482,950 | 11/499,709 | 11/592,984 | 11/601,668 |
| 11/650,546 | 11/246,684 | 11/505,856 | 11/210,687 | 11/097,212 | 09/575,165 | 10/943,874 |
| 10/981,627 | 11/159,196 | 11/228,450 | 11/834,633 | 09/575,198 | 10/917,465 | 11/255,941 |
| 10/291,660 | 11/442,366 | 10/492,154 | 11/513,077 | 10/974,881 | 11/102,842 | 11/155,513 |
| 11/488,066 | 11/066,160 | 10/934,490 | 10/727,163 | 10/727,257 | 11/488,841 | 10/854,521 |
| 10/854,504 | 10/854,497 | 10/854,489 | 11/499,803 | 10/943,907 | 11/225,154 | 10/760,196 |
| 10/760,275 | 10/760,184 | 10/760,186 | 10/760,261 | 11/501,771 | 11/650,554 | 11/014,748 |
| 11/014,761 | 11/014,714 | 11/014,724 | 11/014,739 | 11/014,726 | 11/014,745 | 11/014,712 |
| 11/014,751 | 11/014,743 | 11/014,754 | 11/014,741 | 11/014,767 | 11/014,742 | 11/014,722 |
| 11/642,520 | 10/962,523 | 11/223,022 | 11/013,636 | 11/064,008 | 11/064,013 | 11/478,592 |
| 11/488,867 | 11/601,762 | 11/650,553 | 10/485,805 | 10/510,154 | 10/510,000 | 11/176,158 |
| 11/442,161 | 11/442,126 | 11/505,848 | 11/008,115 | 11/011,120 | 11/012,329 | 11/124,348 |
| 11/209,712 | 11/329,155 | 10/636,274 | 11/478,735 | 11/525,863 | 11/585,964 | 11/764,746 |
| 10/965,737 | 11/202,343 | 11/225,156 | 11/228,433 | 11/272,425 | 11/442,160 | 10/804,048 |
| 10/846,561 | 10/846,647 | 11/144,812 | 11/520,575 | 11/546,437 | 11/592,207 | 09/575,165 |
| 09/575,198 | 11/329,039 | 11/329,040 | 11/442,189 | 11/483,061 | 11/503,078 | 11/520,735 |
| 11/505,858 | 11/525,850 | 11/583,870 | 11/592,983 | 11/592,208 | 11/601,828 | 11/635,482 |
| 11/635,526 | 11/650,545 | 11/653,241 | 11/653,240 | 11/706,300 | 11/740,265 | 11/737,720 |
| 11/739,056 | 11/740,204 | 11/740,223 | 11/753,557 | 11/750,285 | 11/778,559 | 11/838,878 |
| 11,845,669 | 10/503,928 | 10/920,283 | 10/919,249 | 11/045,442 | 11/248,423 | 11/248,422 |
| 11/282,769 | 11/330,060 | 11/442,111 | 11/499,806 | 11/499,710 | 11,749,156 | 11/854,435 |
| 11/853,817 | 10/636,263 | 10/940,653 | 10/942,858 | 11/706,329 | 11/757,385 | 11/758,642 |
| 11/239,232 | 11/107,942 | 11/190,902 | 11/209,711 | 11/478,585 | 11/525,862 | 11/583,875 |
| 11/599,336 | 11,744,183 | 11/758,646 | 11/778,561 | 11/839,532 | 11/838,874 | 11/853,021 |
| 11/868,531 | 10/636,225 | 10/636,223 | 10/729,098 | 10/729,159 | 10/804,042 | 10/831,235 |
| 10/853,681 | 11/501,772 | 11/503,084 | 11/513,073 | 11/706,379 | 11/730,386 | 11/730,784 |
| 11/753,568 | 11/782,591 | 11/859,783 | 11/281,679 | 11,748,482 | 11/778,563 | 11/779,851 |
| 11/778,574 | 11/853,816 | 11/853,814 | 11/853,786 | 11/856,694 | 11/764,760 | 11,853,777 |
| 11/293,800 | 11/293,802 | 11/293,801 | 11/293,808 | 11/293,809 | 11/482,975 | 11/482,970 |
| 11/482,968 | 11/482,972 | 11/482,971 | 11/482,969 | 11/501,775 | 11,744,210 | 11/859,784 |
| 11/685,084 | 11/685,086 | 11/740,925 | 11/763,444 | 11/763,443 | 11/525,858 | 11/599,335 |
| 11/706,380 | 11,736,545 | 11/736,554 | 11/739,047 | 11,749,159 | 11/739,073 | 11/775,160 |
| 11/853,755 | 10/983,060 | 11/739,071 | 11/518,238 | 11/518,280 | 11/518,244 | 11/518,243 |
| 11/518,242 | 11/357,296 | 11/357,298 | 11/357,297 | 11/246,678 | 11/246,679 | 11/246,680 |
| 11/246,681 | 11/246,714 | 11/246,713 | 11/246,689 | 11/246,669 | 11/246,704 | 11/246,710 |
| 11/246,688 | 11/246,716 | 11/246,715 | 11/246,707 | 11/246,706 | 11/246,705 | 11/246,708 |
| 11/246,693 | 11/246,692 | 11/246,696 | 11/246,695 | 11/246,694 | 11/482,958 | 11/482,955 |
| 11/482,962 | 11/482,963 | 11/482,956 | 11/482,954 | 11/482,974 | 11/482,957 | 11/482,987 |
| 11/482,959 | 11/482,960 | 11/482,961 | 11/482,964 | 11/482,965 | 11/482,976 | 11/482,973 |
| 11/495,815 | 11/495,816 | 11/495,817 | 10/803,074 | 10/803,073 | 10/803,076 | 10/803,077 |
| 10/803,079 | 10/922,971 | 10/922,970 | 10/922,836 | 10/922,842 | 10/922,848 | 11/753,559 |
| 10/815,621 | 10/815,638 | 10/815,642 | 10/815,618 | 11,738,974 | 10/815,635 | 10/815,634 |
| 10/815,617 | 10/815,613 | 10/815,614 | 11/488,162 | 11/488,163 | 11/488,164 | 11/488,167 |
| 11/488,168 | 11/488,165 | 11/488,166 | 10/815,636 | 11/041,652 | 11,863,253 | 11,863,255 |
| 11/863,257 | 11,863,258 | 11,863,262 | 11/041,609 | 11/041,626 | 11/041,627 | 11/041,624 |
| 11/041,625 | 11,863,268 | 11,863,269 | 11,863,270 | 11,863,273 | 76,584,733 | 11/041,556 |
| 11/041,580 | 11/041,723 | 11/041,698 | 11/041,648 | 11,863,263 | 11,863,264 | 11,863,265 |
| 11,863,266 | 11,863,267 | 10/815,609 | 10/815,610 | 11/764,694 | 11/607,976 | 11/607,975 |
| 11/607,999 | 11/607,980 | 11/607,979 | 11/607,978 | 11/735,961 | 11/685,074 | 11/696,126 |
| 11/763,446 | 11/635,523 | 11/124,231 | 11/281,445 | 11/524,911 | 11/640,267 | 11/737,142 |
| 11/834,637 | 11/853,019 | 11/863,239 | 11/305,274 | 11/305,273 | 11/305,275 | 11/305,152 |
| 11/305,008 | 11/102,845 | 11/102,861 | 11/248,421 | 11/672,878 | 10/815,628 | 11,845,672 |
| 11/172,815 | 11/172,814 | 11/482,990 | 11/482,986 | 11/482,985 | 11/454,899 | 11/583,942 |

-continued

| | | | | | | |
|---|---|---|---|---|---|---|
| 11/592,990 | 11/831,961 | 11/831,962 | 11/831,963 | 60,951,700 | 11/832,629 | 11/832,637 |
| 60,971,535 | 11/482,980 | 11/563,684 | 11/482,967 | 11/482,966 | 11/482,988 | 11/482,989 |
| 11/293,832 | 11/293,838 | 11/293,825 | 11/293,841 | 11/293,799 | 11/293,798 | 11/124,158 |
| 11/124,196 | 11/124,162 | 11/124,154 | 11/124,174 | 11/124,181 | 11/124,161 | 11/124,156 |
| 11/124,176 | 11/124,187 | 11/124,180 | 11/124,193 | 11/124,183 | 11/124,178 | 11/124,179 |
| 11/124,169 | 11/187,976 | 11/188,011 | 11/188,014 | 11/482,979 | 11/853,018 | 11/228,540 |
| 11/228,501 | 11/228,530 | 11/228,490 | 11/228,531 | 11/228,533 | 11/228,502 | 11/228,507 |
| 11/228,482 | 11/228,505 | 11/228,497 | 11/228,487 | 11/228,529 | 11/228,484 | 11/228,489 |
| 11/228,518 | 11/228,536 | 11/228,496 | 11/228,488 | 11/228,506 | 11/228,526 | 11/228,539 |
| 11/228,538 | 11/228,524 | 11/228,523 | 11/228,519 | 11/228,528 | 11/228,527 | 11/228,525 |
| 11/228,520 | 11/228,498 | 11/228,511 | 11/228,522 | 111/228,515 | 11/228,537 | 11/228,534 |
| 11/228,491 | 11/228,499 | 11/228,509 | 11/228,492 | 11/228,493 | 11/228,510 | 11/228,508 |
| 11/228,512 | 11/228,514 | 11/228,494 | 11/228,495 | 11/228,486 | 11/228,521 | 11/228,517 |
| 11/228,513 | 11/228,503 | 11/228,535 | 11/228,478 | 11/228,479 | 11,772,240 | 11/863,246 |
| 11/863,145 | 11/865,650 | 11/198,235 | 11,861,282 | 11,861,284 | 11/766,052 | 11/592,996 |
| 11/329,163 | 11/450,431 | 11/482,951 | 11/545,566 | 11/583,826 | 11/604,315 | 11/706,950 |
| 11/730,399 | 11,749,121 | 11/753,549 | 11/834,630 | 019936/0467 | 11/474,281 | 11/485,258 |
| 11/706,304 | 11/706,324 | 11/706,326 | 11/706,321 | 11/772,239 | 11/782,598 | 11/829,941 |
| 019804/0802 | 11,852,986 | 11/763,440 | 11/763,442 | 11/246,687 | 11/246,718 | 11/246,686 |
| 11/246,703 | 11/246,711 | 11/246,712 | 11/246,717 | 11/246,709 | 11/246,700 | 11/246,701 |
| 11/246,697 | 11/246,698 | 11/246,699 | 11/246,675 | 11/246,674 | 11/246,667 | 11/829,957 |
| 11/829,960 | 11/829,961 | 11/829,962 | 11/829,963 | 11/829,966 | 11/829,967 | 11/829,968 |
| 11/829,969 | 11/446,227 | 11/472,345 | 11/474,273 | 11/474,279 | 11/482,939 | 11/603,824 |
| 11/601,672 | 11/653,253 | 11/706,328 | 11/706,299 | 11/737,080 | 11/737,041 | 11/778,062 |
| 11/778,566 | 11/782,593 | 11/246,673 | 11/246,683 | 11/246,682 | 60/939,086 | 11,860,538 |
| 11,860,539 | 11/860,540 | 11,860,541 | 11,860,542 | 11/298,774 | 11/329,157 | 11/490,041 |
| 11/501,767 | 11/505,846 | 11/505,857 | 11/524,908 | 11/524,938 | 11/524,912 | 11/592,995 |
| 11/649,773 | 11/650,549 | 11/653,237 | 11/706,378 | 11/706,962 | 11,749,118 | 11/754,937 |
| 11,749,120 | 11/744,885 | 11/779,850 | 11/765,439 | 11/842,950 | 11/839,539 | 11/764,806 |
| 11/782,595 | 11/482,953 | 11/482,977 | 11/544,779 | 11/756,625 | 11/756,626 | 11/756,628 |
| 11/756,629 | 11/756,630 | 11/756,631 | 11/084,796 | 11/084,742 | 10/291,555 | 10/685,583 |
| 10/685,584 | 10/954,170 | 11/020,106 | 11/020,260 | 11/020,321 | 11/020,319 | 11/107,944 |
| 11/107,941 | 11/082,940 | 11/082,815 | 11/182,002 | 11/202,251 | 11/202,252 | 11/202,218 |
| 11/206,778 | 11/203,424 | 11/222,977 | 11/491,225 | 11/491,121 | 11/454,902 | 11/442,385 |
| 11/478,590 | 11/520,170 | 11/603,057 | 11/706,964 | 11/739,032 | 11/830,848 | 11/830,849 |
| 11/839,542 | 11/866,394 | 11/203,205 | 10/982,975 | 10/983,029 | 10/901,154 | 10/932,044 |
| 10/962,412 | 10/965,933 | 10/974,742 | 10/982,974 | 10/986,375 | 11/107,817 | 11/653,219 |
| 11/706,309 | 11/730,389 | 60/953,443 | 11/866,387 | 60,974,077 | 10/778,059 | 10/778,063 |
| 10/917,436 | 10/943,856 | 10/943,878 | 10/943,849 | 11/144,840 | 11/155,556 | 11/155,557 |
| 11/193,481 | 11/193,435 | 11/193,482 | 11/193,479 | 11/298,474 | 11/488,832 | 11/495,814 |
| 11/495,823 | 11/495,822 | 11/495,821 | 11/495,820 | 11/653,242 | 60,911,260 | 11/829,936 |
| 11/839,494 | 11,866,305 | 11,866,313 | 11,866,324 | 11,866,336 | 11,866,348 | 11,866,359 |
| 10/537,159 | 10/786,631 | 10/893,372 | 10/971,146 | 11/842,948 | 10/492,169 | 10/531,229 |
| 10/510,392 | 11/074,800 | 11/075,917 | 11/102,843 | 11/737,094 | 11/753,570 | 11/782,596 |
| 11/865,711 | 11,856,061 | 11,856,062 | 11,856,064 | 11,856,066 | 11/672,522 | 11/672,950 |
| 11/672,947 | 11/672,891 | 11/672,954 | 11/672,533 | 11/754,321 | 11/754,320 | 11/754,319 |
| 11/754,318 | 11/754,317 | 11/754,316 | 11/754,315 | 11/754,314 | 11/754,313 | 11/754,312 |
| 11/754,311 | 11/505,933 | 11/635,480 | 11/706,303 | 11/709,084 | 11/744,143 | 11/779,845 |
| 11/782,589 | 11/863,256 | 11/338,783 | 11/603,823 | 10/727,159 | 10/727,160 | 11/442,131 |
| 11/474,278 | 11,749,750 | 11,749,749 | 11/039,866 | 11/148,237 | 11/478,599 | 11/521,388 |
| 11/482,981 | 11/743,662 | 11/743,661 | 11/743,659 | 11/743,655 | 11/743,657 | 11/752,900 |
| 11/650,537 | 11/712,540 | 10/854,509 | 10/854,516 | 10/854,515 | 10/854,490 | 10/854,523 |
| 10/854,527 | 10/854,519 | 10/854,513 | 10/854,501 | 10/934,628 | 11/601,757 | 11/706,295 |
| 11/735,881 | 11,748,483 | 11,749,123 | 11/766,061 | 11,775,135 | 11,772,235 | 11/778,569 |
| 11/829,942 | 10/954,168 | 11/107,798 | 11/176,372 | 11/478,607 | 11/545,502 | 11/583,943 |
| 11/585,946 | 11/653,239 | 11/653,238 | 11/764,781 | 11/764,782 | 11/779,884 | 11,845,666 |
| 11/544,764 | 11/544,765 | 11/544,772 | 11/544,773 | 11/544,774 | 11/544,775 | 11/544,776 |
| 11/544,766 | 11/544,767 | 11/544,770 | 11/544,769 | 11/544,777 | 11/544,763 | 11/293,804 |
| 11/293,840 | 11/293,803 | 11/293,833 | 11/293,834 | 11/293,835 | 11/293,836 | 11/293,837 |
| 11/293,792 | 11/293,794 | 11/293,839 | 11/293,826 | 11/293,829 | 11/293,830 | 11/293,827 |
| 11/293,828 | 11/293,823 | 11/293,824 | 11/293,831 | 11/293,815 | 11/293,819 | 11/293,818 |
| 11/293,817 | 11/838,875 | 11/482,978 | 11/640,356 | 11/640,357 | 11/640,358 | 11/640,359 |
| 11/640,360 | 11/640,355 | 11/679,786 | 11/474,272 | 11/474,315 | 11/583,874 | 11/706,322 |
| 11/706,968 | 11/749,119 | 11,749,157 | 11/782,590 | 11/855,152 | 11,855,151 | 11/758,640 |
| 11/775,143 | 11/838,877 | 11/778,567 | 11,852,958 | 11,852,907 | 11/872,038 | 11/293,820 |
| 11/293,813 | 11/293,822 | 11/293,812 | 11/293,814 | 11/293,793 | 11/293,842 | 11/293,811 |
| 11/293,807 | 11/293,806 | 11/293,805 | 11/293,810 | 11/688,863 | 11/688,864 | 11/688,865 |
| 11/688,866 | 11/688,867 | 11/688,868 | 11/688,869 | 11/688,871 | 11/688,872 | 11/688,873 |
| 11/741,766 | 11/482,982 | 11/482,983 | 11/482,984 | 11/495,819 | 11/677,049 | 11/677,050 |
| 11/677,051 | 10/760,180 | 10/760,219 | 10/760,237 | 10/760,220 | 10/760,252 | 10/760,265 |
| 11/446,233 | 11/503,083 | 11/503,081 | 11/516,487 | 11/743,672 | 11,744,126 | 11/743,673 |
| 11/543,047 | 11/707,056 | 11,744,211 | 11/767,526 | 11/779,846 | 11/764,227 | 11/829,943 |
| 11/829,944 | 11/014,727 | 10/760,257 | 11/544,547 | 11/585,925 | 11/593,000 | 11/706,298 |
| 11/706,296 | 11/730,760 | 11/730,407 | 11/730,787 | 11/735,977 | 11/736,527 | 11/754,359 |
| 11/778,061 | 11/765,398 | 11/778,556 | 11/829,937 | 11/780,470 | 11/866,399 | 10/853,270 |
| 10/980,184 | 10/983,082 | 10/982,833 | 10/992,748 | 11/013,363 | 11/026,135 | 11/064,005 |
| 11/239,031 | 11/281,419 | 11/484,744 | 11/525,857 | 11/540,569 | 11/583,869 | 11/585,947 |
| 11/604,309 | 11/604,303 | 11/643,844 | 11/655,940 | 11/653,320 | 11/706,323 | 11/706,963 |
| 11/696,186 | 11/730,390 | 11/737,139 | 11/737,749 | 11,749,122 | 11/754,361 | 11/764,775 |
| 11/768,872 | 11/775,156 | 11/779,271 | 11/779,272 | 11/829,938 | 11/839,502 | 11,858,852 |

-continued

| | | | | | | |
|---|---|---|---|---|---|---|
| 11/862,188 | 019863/0806 | 11/872,618 | 10/485,737 | 10/485,744 | 10/509,998 | 11/165,027 |
| 11/225,157 | 11/349,519 | 11/504,602 | 11/520,572 | 11/583,858 | 11/583,895 | 11/585,976 |
| 11/635,488 | 11/706,952 | 11/706,307 | 11/740,287 | 11/758,643 | 11/778,572 | 11/863,260 |
| 10/753,478 | 11/202,217 | 11/298,635 | 11/478,588 | 11/525,861 | 11/545,504 | 11/635,485 |
| 11/730,391 | 11/730,788 | 11/749,148 | 11/749,149 | 11/749,152 | 11/749,151 | 11/759,886 |
| 11/248,832 | 11/485,255 | 11/123,008 | 11/478,591 | 11/482,940 | 11/503,061 | 11/505,938 |
| 11/540,576 | 11/592,991 | 11/599,342 | 11/600,803 | 11/604,302 | 11/635,535 | 11/635,486 |
| 11/643,842 | 11/706,301 | 11/707,039 | 11/730,388 | 11/730,785 | 11/768,875 | 11/779,847 |
| 11/829,940 | 11,847,240 | 11/834,625 | 11/863,210 | 11/865,680 | 10/991,402 | 11/298,530 |
| 11/330,061 | 11/329,284 | 11/454,901 | 11/442,134 | 11/450,441 | 11/474,274 | 10/804,057 |
| 10/804,036 | 11/540,575 | 11/583,937 | 11/635,490 | 11/635,525 | 11/706,366 | 11/706,310 |
| 11/706,308 | 11/785,108 | 11,748,485 | 11/764,778 | 11/766,025 | 11/834,635 | 11,860,420 |
| 11/863,118 | 11/866,307 | 11/866,340 | 11/869,684 | 11/869,694 | 11,758,648 | 11,834,634 |
| 11,782,588 | 11/935,958 | 11,924,608 | 11/869,710 | 11,927,403 | 11/940,304 | 11/872,037 |
| 11/685,090 | 11/940,291 | 11,934,071 | 09/575,181 | 11,863,271 | 11,849,360 | 11,766,713 |
| 11/841,647 | 11/944,450 | 11/935,389 | 11/936,062 | 11/934,027 | 11/934,018 | 11/936,060 |
| 11,877,667 | 11,877,668 | 11/926,121 | 11/764,808 | 11/934,077 | 11/944,404 | 11/936,638 |
| 11,754,310 | 11/940,302 | 11/940,235 | 11/875,936 | 11,926,109 | 11,929,567 | 11/870,342 |
| 11/935,274 | 11/937,239 | 11/872,637 | 11/944,401 | 11/940,215 | 11/872,714 | 11,779,848 |
| 11/870,327 | 11/934,780 | 11/935,992 | RRB038US | 11,872,719 | 11,872,718 | 11/934,781 |
| 29/279,123 | 11,766,043 | 11/923,651 | 11,930,001 | 11,944,451 | 11,859,791 | 11/874,178 |
| 11/936,064 | 11/865,668 | 11/874,168 | 11/874,203 | 11/730,786 | 11/874,156 | 11/923,602 |
| 11,839,541 | 11/865,693 | 11/869,722 | 11/876,592 | 10/943,905 | 10/943,906 | 10/943,904 |
| 10/943,903 | 10/943,902 | 11/474,280 | 10/503,900 | 10/503,922 | 10/503,917 | 10/503,927 |
| 10/920,368 | 10/920,284 | 10/470,947 | 10/203,559 | 10/636,283 | 11/592,181 | 10/636,219 |
| 10/666,124 | 10/683,217 | 10/753,458 | 10/780,625 | 10/831,234 | 10/831,233 | 10/853,117 |
| 11/006,787 | 11/736,540 | 11/212,759 | 11/730,409 | 11/003,786 | 11/003,701 | 11/060,803 |
| 10/753,499 | 11/442,103 | 11/246,676 | 11/246,677 | 11/246,671 | 11/246,670 | 10/815,630 |
| 11/834,628 | 11/839,497 | 11/599,341 | 11/696,650 | 11/056,146 | 10/636,230 | 11/706,297 |
| 11/730,387 | 10/913,372 | 10/913,376 | 11/172,816 | 10/922,872 | 10/922,886 | 10/922,877 |
| 11/293,797 | 11/124,202 | 11/124,197 | 11/124,198 | 11/124,151 | 11/124,160 | 11/124,175 |
| 11/124,173 | 11/124,155 | 11/124,194 | 11/124,164 | 11/124,195 | 11/124,166 | 11/124,150 |
| 11/124,172 | 11/124,165 | 11/124,186 | 11/124,184 | 11/124,182 | 11/124,171 | 11/124,188 |
| 11/124,189 | 11/124,190 | 11/124,177 | 11/735,490 | 11/228,500 | 11/228,504 | 11/228,516 |
| 11/228,477 | 10/868,866 | 11/242,917 | 11/604,323 | 10/534,811 | 10/534,812 | 11/246,691 |
| 11/246,702 | 11/246,668 | 10/760,253 | 10/760,189 | 11/706,965 | 11/246,672 | 10/728,784 |
| 10/728,779 | 10/773,185 | 10/773,187 | 11/060,805 | 11/188,017 | 11/097,309 | 11/097,299 |
| 11/097,310 | 11/097,213 | 11/756,624 | 11/756,627 | 11/712,434 | 10/291,825 | 10/831,232 |
| 10/943,872 | 10/992,713 | 11/082,829 | 11/123,136 | 11/154,676 | 11/286,334 | 11/329,187 |
| 11/349,143 | 11/442,428 | 10/743,671 | 10/900,129 | 10/962,552 | 10/965,733 | 11/250,465 |
| 11/730,392 | 10/778,058 | 10/778,060 | 10/778,062 | 10/778,061 | 10/778,057 | 10/917,467 |
| 10/919,379 | 10/291,559 | 11/074,802 | 11,749,158 | 10/492,161 | 10/502,575 | 10/531,733 |
| 10/683,040 | 10/291,546 | 11/074,777 | 11/540,727 | 10/727,157 | 10/727,192 | 10/727,274 |
| 10/727,161 | 10/727,158 | 10/754,536 | 10/727,227 | 10/934,720 | 11/499,749 | 11/738,518 |
| 10/854,511 | 10/854,524 | 10/854,514 | 11/014,731 | 10/636,234 | 10/636,233 | 11/065,357 |
| 11/503,085 | 11/544,771 | 11/293,816 | 10/760,254 | 10/760,210 | 10/760,222 | 10/760,204 |
| 11/014,764 | 11/014,763 | 11/014,757 | 11/014,723 | 11/014,725 | 11/014,738 | 11/014,734 |
| 11/014,750 | 11/014,718 | 11/014,717 | 11/014,716 | 11/014,732 | 11/097,268 | 11/097,185 |
| 11/097,184 | 11/293,821 | 11/495,818 | 10/760,213 | 11/202,107 | 11/604,324 | 11/185,722 |
| 10/760,214 | 10/962,427 | 10/962,402 | 10/962,425 | 10/962,410 | 11/706,327 | 11/753,566 |
| 11/223,114 | 11/223,021 | 11/223,020 | 11/223,019 | 10/898,214 | 10/976,081 | 10/982,834 |
| 10/992,754 | 11/026,046 | 11/064,004 | 11/075,918 | 11/084,757 | 11/329,188 | 11/329,140 |
| 11/592,985 | 11/706,381 | 11/740,273 | 10/485,738 | 10/510,152 | 10/510,151 | 11/754,367 |
| 11/442,133 | 11/123,007 | 11/177,394 | 11/239,029 | 11/248,428 | 11/248,434 | 11/155,627 |
| 11/159,197 | 11/739,080 | 11/225,173 | 11/330,054 | 11/442,125 | 11/499,741 | 11/520,570 |
| 6,276,850 | 6,520,631 | 6,158,907 | 6,539,180 | 6,270,177 | 6,405,055 | 6,628,430 |
| 6,835,135 | 6,626,529 | 6,981,769 | 7,125,338 | 7,125,337 | 7,136,186 | 7,286,260 |
| 7,145,689 | 7,130,075 | 7,081,974 | 7,177,055 | 7,209,257 | 6,443,555 | 7,161,715 |
| 7,154,632 | 7,158,258 | 7,148,993 | 7,075,684 | 6,966,659 | 6,988,841 | 7,077,748 |
| 7,255,646 | 7,070,270 | 7,014,307 | 7,158,809 | 7,217,048 | 7,271,829 | 7,215,441 |
| 7,056,040 | 6,942,334 | 6,799,853 | 7,237,896 | 6,749,301 | 7,137,678 | 7,252,379 |
| 7,144,107 | 7,220,068 | 7,270,410 | 7,241,005 | 7,108,437 | 7,140,792 | 7,224,274 |
| 7,195,325 | 7,229,164 | 7,150,523 | 7,154,580 | 6,906,778 | 7,167,158 | 7,128,269 |
| 6,688,528 | 6,986,613 | 6,641,315 | 7,278,702 | 7,150,524 | 7,155,395 | 6,915,140 |
| 6,999,206 | 6,795,651 | 6,883,910 | 7,118,481 | 7,136,198 | 7,092,130 | 6,786,661 |
| 6,808,325 | 7,219,990 | 6,750,901 | 6,476,863 | 6,788,336 | 6,322,181 | 6,597,817 |
| 6,227,648 | 6,727,948 | 6,690,419 | 6,619,654 | 6,969,145 | 6,679,582 | 6,568,670 |
| 6,866,373 | 7,280,247 | 7,008,044 | 6,742,871 | 6,966,628 | 6,644,781 | 6,969,143 |
| 6,767,076 | 6,834,933 | 6,692,113 | 6,913,344 | 6,727,951 | 7,128,395 | 7,036,911 |
| 7,032,995 | 6,969,151 | 6,955,424 | 6,969,162 | 6,942,315 | 7,234,797 | 6,986,563 |
| 7,286,162 | 7,283,159 | 7,077,330 | 6,196,541 | 7,226,144 | 7,267,428 | 7,093,929 |
| 7,290,862 | 6,195,150 | 6,362,868 | 6,831,681 | 6,431,669 | 6,362,869 | 6,472,052 |
| 6,356,715 | 6,894,694 | 6,636,216 | 6,366,693 | 6,329,990 | 6,459,495 | 6,137,500 |
| 6,690,416 | 7,050,143 | 6,398,328 | 7,110,024 | 6,431,704 | 6,879,341 | 6,415,054 |
| 6,665,454 | 6,542,645 | 6,486,886 | 6,381,361 | 6,317,192 | 6,850,274 | 6,646,757 |
| 6,624,848 | 6,357,135 | 6,271,931 | 6,353,772 | 6,106,147 | 6,665,008 | 6,304,291 |
| 6,305,770 | 6,289,262 | 6,315,200 | 6,217,165 | 6,496,654 | 6,859,225 | 6,924,835 |
| 6,647,369 | 6,943,830 | 7,021,745 | 6,712,453 | 6,460,971 | 6,428,147 | 6,416,170 |
| 6,402,300 | 6,464,340 | 6,612,687 | 6,412,912 | 6,447,099 | 6,837,567 | 6,505,913 |
| 7,128,845 | 6,733,684 | 7,249,108 | 6,566,858 | 6,331,946 | 6,246,970 | 6,442,525 |

-continued

| | | | | | | |
|---|---|---|---|---|---|---|
| 6,374,354 | 7,246,098 | 6,816,968 | 6,757,832 | 6,334,190 | 6,745,331 | 7,249,109 |
| 7,197,642 | 7,093,139 | 7,210,038 | 7,119,836 | 7,283,162 | 7,286,169 | 7,170,652 |
| 6,967,750 | 6,995,876 | 7,099,051 | 7,172,191 | 7,243,916 | 7,222,845 | 7,285,227 |
| 7,063,940 | 7,193,734 | 7,086,724 | 7,090,337 | 7,278,723 | 7,140,717 | 7,256,824 |
| 7,140,726 | 7,156,512 | 7,186,499 | 6,750,944 | 7,291,447 | 6,985,207 | 6,773,874 |
| 6,650,836 | 7,250,975 | 6,880,929 | 7,236,188 | 7,236,187 | 7,155,394 | 7,055,927 |
| 6,986,562 | 7,052,103 | 7,289,142 | 7,095,533 | 6,914,686 | 6,896,252 | 6,820,871 |
| 6,834,851 | 6,848,686 | 6,830,246 | 6,851,671 | 7,092,011 | 7,187,404 | 6,878,299 |
| 6,929,348 | 6,921,154 | 6,913,346 | 7,246,897 | 7,077,515 | 6,913,875 | 7,021,758 |
| 7,033,017 | 7,161,709 | 7,099,033 | 7,147,294 | 7,156,494 | 7,032,998 | 7,044,585 |
| 7,296,867 | 6,994,424 | 7,258,435 | 7,097,263 | 7,001,012 | 7,004,568 | 7,040,738 |
| 7,188,933 | 7,027,080 | 7,025,446 | 6,991,321 | 7,131,715 | 7,261,392 | 7,207,647 |
| 7,182,435 | 7,097,285 | 7,097,284 | 7,083,264 | 7,147,304 | 7,232,203 | 7,156,498 |
| 7,201,471 | 7,210,764 | 6,710,457 | 6,775,906 | 6,507,099 | 7,221,043 | 7,107,674 |
| 7,154,172 | 7,247,941 | 6,530,339 | 6,631,897 | 6,851,667 | 6,830,243 | 6,860,479 |
| 6,997,452 | 7,000,913 | 7,204,482 | 6,238,044 | 6,425,661 | 7,258,417 | 7,270,395 |
| 7,255,419 | 7,284,819 | 7,229,148 | 7,258,416 | 7,273,263 | 7,270,393 | 6,984,017 |
| 7,156,497 | 7,284,820 | 7,246,875 | 6,431,777 | 6,334,664 | 6,447,113 | 7,239,407 |
| 6,398,359 | 6,652,089 | 6,652,090 | 7,057,759 | 6,631,986 | 7,187,470 | 7,280,235 |
| 6,471,331 | 6,676,250 | 6,347,864 | 6,439,704 | 6,425,700 | 6,588,952 | 6,626,515 |
| 6,722,758 | 6,871,937 | 7,249,942 | 7,206,654 | 7,162,324 | 7,162,325 | 7,231,275 |
| 7,146,236 | 7,278,847 | 6,997,698 | 7,220,112 | 7,231,276 | 7,220,115 | 7,195,475 |
| 7,144,242 | 6,786,420 | 6,827,282 | 6,948,661 | 7,073,713 | 7,093,762 | 7,083,108 |
| 7,222,799 | 7,201,319 | 7,032,899 | 6,854,724 | 6,350,023 | 6,318,849 | 6,592,207 |
| 6,439,699 | 6,312,114 | 7,040,823 | 7,125,185 | 7,229,226 | 7,243,835 | 7,251,050 |
| 7,097,094 | 7,137,549 | 7,156,292 | 7,137,566 | 7,131,596 | 7,128,265 | 7,207,485 |
| 7,197,374 | 7,175,089 | 7,178,719 | 7,207,483 | 7,296,737 | 7,270,266 | 7,267,273 |
| 7,128,270 | 7,150,398 | 7,159,777 | 7,188,769 | 7,097,106 | 7,070,110 | 7,243,849 |
| 6,227,652 | 6,213,588 | 6,213,589 | 6,231,163 | 6,247,795 | 6,394,581 | 6,244,691 |
| 6,257,704 | 6,416,168 | 6,220,694 | 6,257,705 | 6,247,794 | 6,234,610 | 6,247,793 |
| 6,264,306 | 6,241,342 | 6,247,792 | 6,264,307 | 6,254,220 | 6,234,611 | 6,302,528 |
| 6,283,582 | 6,239,821 | 6,338,547 | 6,247,796 | 6,557,977 | 6,390,603 | 6,362,843 |
| 6,293,653 | 6,312,107 | 6,227,653 | 6,234,609 | 6,238,040 | 6,188,415 | 6,227,654 |
| 6,209,989 | 6,247,791 | 6,336,710 | 6,217,153 | 6,416,167 | 6,243,113 | 6,283,581 |
| 6,247,790 | 6,260,953 | 6,267,469 | 6,588,882 | 6,742,873 | 6,918,655 | 6,547,371 |
| 6,938,989 | 6,598,964 | 6,923,526 | 6,273,544 | 6,309,048 | 6,420,196 | 6,443,558 |
| 6,439,689 | 6,378,989 | 6,848,181 | 6,634,735 | 6,299,289 | 6,299,290 | 6,425,654 |
| 6,902,255 | 6,623,101 | 6,406,129 | 6,505,916 | 6,457,809 | 6,550,895 | 6,457,812 |
| 7,152,962 | 6,428,133 | 7,216,956 | 7,080,895 | 7,182,437 | 6,224,780 | 6,235,212 |
| 6,280,643 | 6,284,147 | 6,214,244 | 6,071,750 | 6,267,905 | 6,251,298 | 6,258,285 |
| 6,225,138 | 6,241,904 | 6,299,786 | 6,866,789 | 6,231,773 | 6,190,931 | 6,248,249 |
| 6,290,862 | 6,241,906 | 6,565,762 | 6,241,905 | 6,451,216 | 6,231,772 | 6,274,056 |
| 6,290,861 | 6,248,248 | 6,306,671 | 6,331,258 | 6,110,754 | 6,294,101 | 6,416,679 |
| 6,264,849 | 6,254,793 | 6,245,246 | 6,855,264 | 6,235,211 | 6,491,833 | 6,264,850 |
| 6,258,284 | 6,312,615 | 6,228,668 | 6,180,427 | 6,171,875 | 6,267,904 | 6,245,247 |
| 6,315,914 | 7,169,316 | 6,526,658 | 7,210,767 | 6,665,094 | 6,450,605 | 6,512,596 |
| 6,654,144 | 7,125,090 | 6,687,022 | 7,072,076 | 7,092,125 | 7,215,443 | 7,136,195 |
| 7,077,494 | 6,877,834 | 6,969,139 | 7,283,280 | 6,912,067 | 7,277,205 | 7,154,637 |
| 7,070,251 | 6,851,782 | 6,843,545 | 7,079,286 | 7,064,867 | 7,065,247 | 7,027,177 |
| 7,218,415 | 7,064,873 | 6,954,276 | 7,061,644 | 7,092,127 | 7,059,695 | 7,177,052 |
| 7,270,394 | 7,188,921 | 7,187,469 | 7,196,820 | 7,283,281 | 7,251,051 | 7,245,399 |
| 6,231,148 | 6,293,658 | 6,614,560 | 6,238,033 | 6,312,070 | 6,238,111 | 6,378,970 |
| 6,196,739 | 6,270,182 | 6,152,619 | 7,006,143 | 6,876,394 | 6,738,096 | 6,970,186 |
| 6,287,028 | 6,412,993 | 7,204,941 | 7,282,164 | 7,278,727 | 7,138,391 | 7,153,956 |
| 7,122,076 | 7,148,345 | 7,252,366 | 7,275,811 | 7,234,795 | 7,147,792 | 7,175,774 |
| 7,284,921 | 7,236,271 | 6,238,115 | 6,386,535 | 6,398,344 | 6,612,240 | 6,752,549 |
| 6,805,049 | 6,971,313 | 6,899,480 | 6,860,664 | 6,925,935 | 6,966,636 | 7,024,995 |
| 7,284,852 | 6,926,455 | 7,056,038 | 6,869,172 | 7,021,843 | 6,988,845 | 6,964,533 |
| 6,981,809 | 7,284,822 | 7,258,067 | 7,222,941 | 7,284,925 | 7,278,795 | 7,249,904 |
| 6,087,638 | 6,340,222 | 6,041,600 | 6,299,300 | 6,067,797 | 6,286,935 | 6,044,646 |
| 6,382,769 | 6,787,051 | 6,938,990 | 7,152,972 | D529952 | 6,390,605 | 6,322,195 |
| 6,612,110 | 6,480,089 | 6,460,778 | 6,305,788 | 6,426,014 | 6,364,453 | 6,457,795 |
| 6,315,399 | 6,338,548 | 7,040,736 | 6,938,992 | 6,994,425 | 6,863,379 | 6,540,319 |
| 6,994,421 | 6,984,019 | 7,008,043 | 6,997,544 | 6,328,431 | 6,991,310 | 7,140,723 |
| 6,328,425 | 6,982,184 | 7,267,423 | 7,134,741 | 7,066,577 | 7,152,945 | 7,021,744 |
| 6,991,320 | 7,155,911 | 6,595,624 | 7,152,943 | 7,125,103 | 7,290,857 | 7,285,437 |
| 7,229,151 | 7,237,873 | 7,213,907 | 6,417,757 | 7,095,309 | 6,854,825 | 6,623,106 |
| 6,672,707 | 6,575,561 | 6,817,700 | 6,588,885 | 7,075,677 | 6,428,139 | 6,575,549 |
| 6,846,692 | 6,425,971 | 7,063,993 | 6,383,833 | 6,955,414 | 6,412,908 | 6,746,105 |
| 6,953,236 | 6,412,904 | 7,128,388 | 6,398,343 | 6,652,071 | 6,793,323 | 6,659,590 |
| 6,676,245 | 7,201,460 | 6,464,332 | 6,659,593 | 6,478,406 | 6,978,613 | 6,439,693 |
| 6,502,306 | 6,966,111 | 6,863,369 | 6,428,142 | 6,874,868 | 6,390,591 | 6,799,828 |
| 6,896,358 | 7,018,016 | 6,328,417 | 6,322,194 | 6,382,779 | 6,629,745 | 6,565,193 |
| 6,609,786 | 6,609,787 | 6,439,908 | 6,684,503 | 6,843,551 | 6,764,166 | 6,561,617 |
| 6,557,970 | 6,546,628 | 6,652,074 | 6,820,968 | 7,175,260 | 6,682,174 | 6,648,453 |
| 6,834,932 | 6,682,176 | 6,998,062 | 6,767,077 | 7,278,717 | 6,755,509 | 6,692,108 |
| 6,672,709 | 7,086,718 | 6,672,710 | 6,669,334 | 7,152,958 | 7,281,782 | 6,824,246 |
| 7,264,336 | 6,669,333 | 6,820,967 | 6,736,489 | 7,264,335 | 6,719,406 | 7,222,943 |
| 7,188,419 | 7,168,166 | 6,974,209 | 7,086,719 | 6,974,210 | 7,195,338 | 7,252,775 |
| 7,101,025 | 7,156,508 | 7,159,972 | 7,083,271 | 7,165,834 | 7,080,894 | 7,201,469 |

-continued

| | | | | | | |
|---|---|---|---|---|---|---|
| 7,090,336 | 7,156,489 | 7,083,257 | 7,258,422 | 7,255,423 | 7,219,980 | 7,118,192 |
| 7,077,505 | 7,198,354 | 7,077,504 | 7,198,355 | 7,152,959 | 7,213,906 | 7,178,901 |
| 7,222,938 | 7,108,353 | 7,104,629 | 7,261,401 | 7,246,886 | 7,128,400 | 7,108,355 |
| 6,991,322 | 7,287,836 | 7,118,197 | 7,077,493 | 6,962,402 | 7,147,308 | 7,118,198 |
| 7,168,790 | 7,172,270 | 7,229,155 | 6,830,318 | 7,195,342 | 7,175,261 | 7,108,356 |
| 7,118,202 | 7,134,744 | 7,134,743 | 7,182,439 | 7,210,768 | 7,134,745 | 7,156,484 |
| 7,118,201 | 7,111,926 | 7,018,021 | 7,128,402 | 7,284,839 | 7,246,885 | 7,229,156 |
| 7,258,427 | 7,278,716 | 7,246,876 | 7,147,306 | 7,261,394 | 7,156,289 | 7,178,718 |
| 7,225,979 | 7,079,712 | 6,825,945 | 6,813,039 | 7,190,474 | 6,987,506 | 6,824,044 |
| 7,038,797 | 6,980,318 | 6,816,274 | 7,102,772 | 6,681,045 | 6,678,499 | 6,679,420 |
| 6,963,845 | 6,976,220 | 6,728,000 | 7,110,126 | 7,173,722 | 6,976,035 | 6,813,558 |
| 6,766,942 | 6,965,454 | 6,995,859 | 7,088,459 | 6,720,985 | 7,286,113 | 6,922,779 |
| 6,978,019 | 6,847,883 | 7,131,058 | 7,295,839 | 6,959,298 | 6,973,450 | 7,150,404 |
| 6,965,882 | 7,233,924 | 7,175,079 | 7,162,259 | 6,718,061 | 7,012,710 | 6,825,956 |
| 7,222,098 | 7,263,508 | 7,031,010 | 6,972,864 | 6,862,105 | 7,009,738 | 6,989,911 |
| 6,982,807 | 6,829,387 | 6,714,678 | 6,644,545 | 6,609,653 | 6,651,879 | 7,293,240 |
| 7,044,363 | 7,004,390 | 6,867,880 | 7,034,953 | 6,987,581 | 7,216,224 | 7,162,269 |
| 7,162,222 | 7,290,210 | 7,293,233 | 7,293,234 | 6,850,931 | 6,865,570 | 6,847,961 |
| 7,162,442 | 7,159,784 | 6,889,896 | 7,174,056 | 6,996,274 | 7,162,088 | 7,259,884 |
| 7,167,270 | 6,986,459 | 7,181,448 | 7,231,293 | 7,174,329 | 7,295,922 | 7,200,591 |
| 6,991,153 | 6,991,154 | 7,225,402 | 7,271,931 | 7,068,382 | 7,007,851 | 6,957,921 |
| 6,457,883 | 7,044,381 | 7,094,910 | 7,091,344 | 7,122,685 | 7,038,066 | 7,099,019 |
| 7,062,651 | 6,789,194 | 6,789,191 | 7,278,018 | 6,644,642 | 6,502,614 | 6,622,999 |
| 6,669,385 | 6,827,116 | 7,011,128 | 6,549,935 | 6,987,573 | 6,727,996 | 6,591,884 |
| 6,439,706 | 6,760,119 | 7,064,851 | 6,826,547 | 6,290,349 | 6,428,155 | 6,785,016 |
| 6,831,682 | 6,741,871 | 6,927,871 | 6,980,306 | 6,965,439 | 6,840,606 | 7,036,918 |
| 6,977,746 | 6,970,264 | 7,068,389 | 7,093,991 | 7,190,491 | 7,177,054 | 7,180,609 |
| 7,292,363 | 7,202,959 | 6,982,798 | 6,870,966 | 6,822,639 | 6,474,888 | 6,627,870 |
| 6,724,374 | 6,788,982 | 7,263,270 | 6,788,293 | 6,946,672 | 6,737,591 | 7,091,960 |
| 6,792,165 | 7,105,753 | 6,795,593 | 6,980,704 | 6,768,821 | 7,132,612 | 7,041,916 |
| 6,797,895 | 7,015,901 | 7,289,882 | 7,148,644 | 7,096,199 | 7,286,887 | 7,218,978 |
| 7,245,294 | 7,277,085 | 7,187,370 | 7,019,319 | 7,043,096 | 7,148,499 | 7,245,760 |
| 7,055,739 | 7,233,320 | 6,830,196 | 6,832,717 | 7,182,247 | 7,120,853 | 7,082,562 |
| 6,843,420 | 6,789,731 | 7,057,608 | 6,766,944 | 6,766,945 | 7,289,103 | 7,264,173 |
| 10/409,864 | 7,108,192 | 7,111,791 | 7,077,333 | 6,983,878 | 7,134,598 | 6,929,186 |
| 6,994,264 | 7,017,826 | 7,014,123 | 7,134,601 | 7,150,396 | 7,017,823 | 7,025,276 |
| 7,284,701 | 7,080,780 | 6,957,768 | 7,170,499 | 7,106,888 | 7,123,239 | 6,982,701 |
| 6,982,703 | 7,227,527 | 6,786,397 | 6,947,027 | 6,975,299 | 7,139,431 | 7,048,178 |
| 7,118,025 | 6,839,053 | 7,015,900 | 7,010,147 | 7,133,557 | 6,914,593 | 6,938,826 |
| 7,278,566 | 7,123,245 | 6,992,662 | 7,190,346 | 7,221,781 | 7,213,756 | 7,180,507 |
| 7,263,225 | 7,287,688 | 6,593,166 | 7,132,679 | 6,940,088 | 7,119,357 | 6,755,513 |
| 6,974,204 | 6,409,323 | 7,055,930 | 6,281,912 | 6,893,109 | 6,604,810 | 6,824,242 |
| 6,318,920 | 7,210,867 | 6,488,422 | 6,655,786 | 6,457,810 | 6,485,135 | 6,796,731 |
| 6,904,678 | 6,641,253 | 7,125,106 | 6,786,658 | 7,097,273 | 6,824,245 | 7,222,947 |
| 6,918,649 | 6,860,581 | 6,929,351 | 7,063,404 | 6,969,150 | 7,004,652 | 6,871,938 |
| 6,905,194 | 6,846,059 | 6,997,626 | 7,029,098 | 6,966,625 | 7,114,794 | 7,207,646 |
| 7,077,496 | 7,284,831 | 7,152,938 | 7,182,434 | 7,182,430 | 7,032,993 | 7,172,266 |
| 7,258,430 | 7,128,392 | 7,210,866 | 7,287,831 | 6,804,030 | 6,807,315 | 6,771,811 |
| 6,683,996 | 7,271,936 | 6,965,691 | 7,058,219 | 7,289,681 | 7,187,807 | 7,181,063 |
| 7,121,639 | 7,165,824 | 7,152,942 | 7,181,572 | 7,096,137 | 7,278,034 | 7,188,282 |
| 7,171,323 | 7,278,697 | 6,795,215 | 7,070,098 | 7,154,638 | 6,805,419 | 6,859,289 |
| 6,977,751 | 6,398,332 | 6,394,573 | 6,622,923 | 6,747,760 | 6,921,144 | 7,092,112 |
| 7,192,106 | 7,173,739 | 6,986,560 | 7,008,033 | 7,222,780 | 7,270,391 | 7,150,510 |
| 7,195,328 | 7,182,422 | 7,281,330 | 7,188,928 | 7,093,989 | 7,252,353 | 7,267,417 |
| 7,275,805 | 7,281,777 | 7,290,852 | 7,266,661 | 7,243,193 | 7,163,345 | D529081 |
| D541848 | D528597 | 6,924,907 | 6,712,452 | 6,416,160 | 6,238,043 | 6,958,826 |
| 6,812,972 | 6,553,459 | 6,967,741 | 6,956,669 | 6,903,766 | 6,804,026 | 7,259,889 |
| 6,975,429 | 7,301,567 | 7,274,485 | 7,139,084 | 7,173,735 | 7,068,394 | 7,286,182 |
| 7,086,644 | 7,250,977 | 7,146,281 | 7,023,567 | 7,136,183 | 7,083,254 | 6,796,651 |
| 7,061,643 | 7,057,758 | 6,894,810 | 6,995,871 | 7,085,010 | 7,092,126 | 7,123,382 |
| 7,061,650 | 6,986,573 | 6,974,212 | 7,173,737 | 7,246,868 | 7,137,699 | 7,148,994 |
| 7,077,497 | 7,248,376 | 7,173,729 | 7,270,494 | 7,201,468 | 7,234,802 | 7,287,846 |
| 7,156,511 | 7,258,432 | 7,097,291 | 7,083,273 | 7,198,352 | 7,201,470 | 7,121,655 |
| 7,232,208 | 7,083,272 | 7,261,400 | 7,249,822 | 7,270,405 | 7,249,833 | 7,284,816 |
| 7,284,845 | 7,255,430 | D528156 | 7,111,935 | 7,261,482 | 7,002,664 | 7,088,420 |
| 6,364,451 | 6,533,390 | 6,454,378 | 7,224,478 | 6,559,969 | 6,896,362 | 7,057,760 |
| 6,982,799 | 7,093,494 | 7,143,652 | 7,089,797 | 7,159,467 | 7,234,357 | 7,124,643 |
| 7,121,145 | 7,089,790 | 7,194,901 | 6,968,744 | 7,089,798 | 7,240,560 | 7,137,302 |
| 7,171,855 | 7,260,995 | 7,260,993 | 7,165,460 | 7,222,538 | 7,258,019 | 7,258,020 |
| 6,454,482 | 6,808,330 | 6,527,365 | 6,474,773 | 6,550,997 | 7,093,923 | 6,957,923 |
| 7,131,724 | 7,168,867 | 7,125,098 | 7,249,901 | 7,188,930 | D536031 | D531214 |
| 7,237,888 | 7,168,654 | 7,201,272 | 6,991,098 | 7,217,051 | 6,944,970 | 7,108,434 |
| 7,210,407 | 7,186,042 | 6,920,704 | 7,217,049 | 7,147,102 | 7,287,828 | 7,249,838 |
| 7,261,477 | 7,225,739 | 7,191,978 | 7,163,287 | 7,258,415 | 7,258,424 | 7,195,412 |
| 7,207,670 | 7,270,401 | 7,220,072 | D541849 | 6,716,666 | 6,949,217 | 6,750,083 |
| 7,014,451 | 6,777,259 | 6,923,524 | 6,557,978 | 6,991,207 | 6,766,998 | 6,967,354 |
| 6,759,723 | 6,870,259 | 6,925,875 | 7,095,109 | 7,145,696 | 7,193,482 | 7,134,739 |
| 7,222,939 | 7,164,501 | 7,118,186 | 7,201,523 | 7,226,159 | 7,249,839 | 7,108,343 |
| 7,154,626 | 7,079,292 | 7,233,421 | 7,063,408 | 7,032,996 | 7,217,046 | 6,948,870 |
| 7,195,336 | 7,070,257 | 7,093,922 | 6,988,789 | 7,246,871 | 7,187,468 | 7,196,814 |

-continued

| | | | | | | |
|---|---|---|---|---|---|---|
| 7,268,911 | 7,265,869 | 7,128,384 | 7,164,505 | 7,284,805 | 7,025,434 | 7,298,519 |
| 7,280,244 | 7,206,098 | 7,265,877 | 7,193,743 | 7,168,777 | 7,195,329 | 7,198,346 |
| 7,281,786 | 6,959,983 | 7,128,386 | 7,097,104 | 7,083,261 | 7,070,258 | 7,083,275 |
| 7,110,139 | 6,994,419 | 6,935,725 | 7,178,892 | 7,219,429 | 6,988,784 | 7,289,156 |
| 7,284,976 | 7,178,903 | 7,273,274 | 7,083,256 | 7,278,707 | 6,974,206 | 7,066,588 |
| 7,222,940 | 7,018,025 | 7,221,867 | 7,290,863 | 7,188,938 | 7,021,742 | 7,083,262 |
| 7,192,119 | 11/083,021 | 7,036,912 | 7,175,256 | 7,182,441 | 7,083,258 | 7,114,796 |
| 7,147,302 | 7,219,982 | 7,118,195 | 7,229,153 | 6,991,318 | 7,108,346 | 7,178,899 |
| 7,066,579 | 7,270,397 | 7,258,425 | 7,237,874 | 7,152,961 | 7,207,658 | 7,207,659 |
| 7,278,713 | 7,290,853 | 6,485,123 | 6,425,657 | 6,488,358 | 7,021,746 | 6,712,986 |
| 6,981,757 | 6,505,912 | 6,439,694 | 6,364,461 | 6,378,990 | 6,425,658 | 6,488,361 |
| 6,814,429 | 6,471,336 | 6,457,813 | 6,540,331 | 6,454,396 | 6,464,325 | 6,443,559 |
| 6,435,664 | 6,412,914 | 6,488,360 | 6,550,896 | 6,439,695 | 6,447,100 | 6,488,359 |
| 6,637,873 | 6,618,117 | 6,803,989 | 7,234,801 | 7,044,589 | 7,163,273 | 6,416,154 |
| 6,547,364 | 6,644,771 | 7,152,939 | 6,565,181 | 6,857,719 | 7,255,414 | 6,702,417 |
| 7,284,843 | 6,918,654 | 7,070,265 | 6,616,271 | 6,652,078 | 6,503,408 | 6,607,263 |
| 7,111,924 | 6,623,108 | 6,698,867 | 6,488,362 | 6,625,874 | 6,921,153 | 7,198,356 |
| 6,536,874 | 6,425,651 | 6,435,667 | 6,527,374 | 6,582,059 | 6,513,908 | 7,246,883 |
| 6,540,332 | 6,547,368 | 7,070,256 | 6,508,546 | 6,679,584 | 6,857,724 | 6,652,052 |
| 6,672,706 | 6,688,719 | 6,712,924 | 6,588,886 | 7,077,508 | 7,207,654 | 6,935,724 |
| 6,927,786 | 6,988,787 | 6,899,415 | 6,672,708 | 6,644,767 | 6,874,866 | 6,830,316 |
| 6,994,420 | 6,954,254 | 7,086,720 | 7,240,992 | 7,267,424 | 7,128,397 | 7,084,951 |
| 7,156,496 | 7,066,578 | 7,101,023 | 7,159,965 | 7,255,424 | 7,137,686 | 7,201,472 |
| 7,287,829 | 7,216,957 | 7,278,712 | 7,287,827 | 6,916,082 | 6,786,570 | 6,848,780 |
| 6,966,633 | 7,179,395 | 6,969,153 | 6,979,075 | 7,132,056 | 6,832,828 | 6,860,590 |
| 6,905,620 | 6,786,574 | 6,824,252 | 7,097,282 | 6,997,545 | 6,971,734 | 6,918,652 |
| 6,978,990 | 6,863,105 | 7,194,629 | 6,890,059 | 6,988,785 | 6,830,315 | 7,246,881 |
| 7,125,102 | 7,028,474 | 7,066,575 | 6,986,202 | 7,044,584 | 7,210,762 | 7,032,992 |
| 7,140,720 | 7,207,656 | 7,285,170 | 7,008,041 | 7,011,390 | 7,048,868 | 7,014,785 |
| 7,131,717 | 7,284,826 | 7,182,436 | 7,104,631 | 7,240,993 | 7,290,859 | 7,172,265 |
| 7,284,837 | 7,066,573 | 7,152,949 | 7,156,492 | 7,287,834 | 7,284,326 | 6,824,257 |
| 7,270,475 | 6,971,811 | 6,878,564 | 6,921,145 | 6,890,052 | 7,021,747 | 6,929,345 |
| 6,811,242 | 6,916,087 | 6,905,195 | 6,899,416 | 6,883,906 | 6,955,428 | 7,284,834 |
| 6,932,459 | 6,962,410 | 7,033,008 | 6,962,409 | 7,013,641 | 7,204,580 | 7,032,997 |
| 6,998,278 | 7,004,563 | 6,910,755 | 6,969,142 | 6,938,994 | 7,188,935 | 7,134,740 |
| 6,997,537 | 7,004,567 | 6,916,091 | 7,077,588 | 6,918,707 | 6,923,583 | 6,953,295 |
| 6,921,221 | 7,001,008 | 7,168,167 | 7,210,759 | 6,988,790 | 7,192,120 | 7,168,789 |
| 7,004,577 | 7,052,120 | 6,994,426 | 7,258,418 | 7,014,298 | 7,152,955 | 7,097,292 |
| 7,207,657 | 7,152,944 | 7,147,303 | 7,134,608 | 7,264,333 | 7,093,921 | 7,077,590 |
| 7,147,297 | 7,077,507 | 7,172,672 | 7,175,776 | 7,086,717 | 7,101,020 | 7,201,466 |
| 7,152,967 | 7,182,431 | 7,210,666 | 7,252,367 | 7,287,837 | 6,945,630 | 7,018,294 |
| 6,910,014 | 6,659,447 | 6,648,321 | 7,082,980 | 6,672,584 | 7,073,551 | 6,830,395 |
| 7,289,727 | 7,001,011 | 6,880,922 | 6,886,915 | 6,644,787 | 6,641,255 | 7,066,580 |
| 6,652,082 | 7,284,833 | 6,666,544 | 6,666,543 | 6,669,332 | 6,984,023 | 6,733,104 |
| 6,644,793 | 6,723,575 | 6,953,235 | 6,663,225 | 7,076,872 | 7,059,706 | 7,185,971 |
| 7,090,335 | 6,854,827 | 6,793,974 | 7,222,929 | 6,739,701 | 7,073,881 | 7,155,823 |
| 7,219,427 | 7,008,503 | 6,783,216 | 6,883,890 | 6,857,726 | 6,641,256 | 6,808,253 |
| 6,827,428 | 6,802,587 | 6,997,534 | 6,959,982 | 6,959,981 | 6,886,917 | 6,969,473 |
| 6,827,425 | 7,007,859 | 6,802,594 | 6,792,754 | 6,860,107 | 6,786,043 | 6,863,378 |
| 7,052,114 | 7,001,007 | 6,948,794 | 6,805,435 | 6,733,116 | 7,008,046 | 6,880,918 |
| 7,066,574 | 6,983,595 | 6,923,527 | 7,275,800 | 7,163,276 | 7,156,495 | 6,976,751 |
| 6,994,430 | 7,014,296 | 7,059,704 | 7,160,743 | 7,175,775 | 7,287,839 | 7,097,283 |
| 7,140,722 | 7,080,893 | 7,093,920 | 7,270,492 | 7,128,093 | 7,052,113 | 7,055,934 |
| 7,278,796 | 7,083,263 | 7,145,592 | 7,025,436 | 7,258,421 | 7,226,147 | 7,195,339 |
| 7,284,838 | 7,067,067 | 6,776,476 | 6,880,914 | 7,086,709 | 6,783,217 | 7,147,791 |
| 6,929,352 | 7,144,095 | 6,820,974 | 6,918,647 | 6,984,016 | 7,192,125 | 6,824,251 |
| 6,834,939 | 6,840,600 | 6,786,573 | 7,144,519 | 6,799,835 | 6,959,975 | 6,959,974 |
| 7,021,740 | 6,935,718 | 6,938,983 | 6,938,991 | 7,226,145 | 7,140,719 | 6,988,788 |
| 7,022,250 | 6,929,350 | 7,011,393 | 7,004,566 | 7,175,097 | 6,948,799 | 7,143,944 |
| 7,029,100 | 6,957,811 | 7,073,724 | 7,055,933 | 7,077,490 | 7,055,940 | 7,234,645 |
| 7,032,999 | 7,066,576 | 7,229,150 | 7,086,728 | 7,246,879 | 7,284,825 | 7,140,718 |
| 7,284,817 | 7,144,098 | 7,044,577 | 7,284,824 | 7,284,827 | 7,189,334 | 7,055,935 |
| 7,152,860 | 7,213,989 | 7,114,868 | 7,168,796 | 7,159,967 | 7,152,805 | 7,133,799 |
| 7,152,956 | 7,128,399 | 7,147,305 | 7,287,702 | 7,246,884 | 7,152,960 | 7,270,399 |
| 6,857,728 | 6,857,729 | 6,857,730 | 6,989,292 | 7,126,216 | 6,977,189 | 6,982,189 |
| 7,173,332 | 7,026,176 | 6,979,599 | 6,812,062 | 6,886,751 | 7,001,793 | 6,866,369 |
| 6,946,743 | 6,886,918 | 7,059,720 | 6,951,390 | 6,981,765 | 6,789,881 | 6,802,592 |
| 7,029,097 | 6,799,836 | 7,048,352 | 7,182,267 | 7,025,279 | 6,857,571 | 6,817,539 |
| 6,830,198 | 6,992,791 | 7,038,809 | 6,980,323 | 7,148,992 | 7,139,091 | 6,947,173 |
| 7,101,034 | 6,969,144 | 6,942,319 | 6,827,427 | 6,984,021 | 6,984,022 | 6,869,167 |
| 6,918,542 | 7,007,852 | 6,899,420 | 6,918,665 | 6,997,625 | 6,988,840 | 6,984,080 |
| 6,845,978 | 6,848,687 | 6,840,512 | 6,863,365 | 7,204,582 | 6,921,150 | 7,128,396 |
| 6,913,347 | 7,008,819 | 6,935,736 | 6,991,317 | 7,284,836 | 7,055,947 | 7,093,928 |
| 7,100,834 | 7,270,396 | 7,187,086 | 7,290,856 | 7,032,825 | 7,086,721 | 7,159,968 |
| 7,010,456 | 7,147,307 | 7,111,925 | 7,229,154 | 7,278,711 | 7,290,720 | 7,287,706 |
| 7,079,712 | 6,825,945 | 6,813,039 | 6,987,506 | 7,038,797 | 6,980,318 | 6,816,274 |
| 7,102,772 | 6,681,045 | 6,728,000 | 7,173,722 | 7,088,459 | 7,068,382 | 7,062,651 |
| 6,789,194 | 6,789,191 | 6,644,642 | 6,502,614 | 6,622,999 | 6,669,385 | 6,549,935 |
| 6,987,573 | 6,727,996 | 6,591,884 | 6,439,706 | 6,760,119 | 6,290,349 | 6,428,155 |
| 6,785,016 | 6,870,966 | 6,822,639 | 6,737,591 | 7,055,739 | 7,233,320 | 6,830,196 |

-continued

| | | | | | | |
|---|---|---|---|---|---|---|
| 6,832,717 | 6,957,768 | 7,170,499 | 7,106,888 | 7,123,239 | 11/225,172 | 10/466,440 |
| 10/451,722 | 10/503,898 | 10/503,897 | 10/503,918 | 10/503,925 | 10/503,885 | 10/503,889 |
| 10/503,891 | 11/006,577 | 11/185,725 | 11/202,344 | 09/113,054 | 09/693,317 | 09/505,951 |
| 10/866,608 | 10/636,285 | 11/540,574 | 10/636,224 | 10/656,281 | 10/656,791 | 10/831,238 |
| 10/831,237 | 10/831,239 | 10/831,240 | 10/831,241 | 10/853,336 | 10/853,659 | 11/012,024 |
| 11/011,925 | 11/635,524 | 11/442,400 | 11/003,404 | 11/003,419 | 11/003,699 | 11/071,473 |
| 11/003,463 | 11/003,683 | 11/003,614 | 10/753,440 | 10/803,078 | 10/922,843 | 11/513,386 |
| 10/815,637 | 10/815,647 | 10/815,620 | 11/041,650 | 11/041,651 | 11/041,649 | 11/041,610 |
| 11/480,957 | 11/144,844 | 11/635,533 | 11/696,144 | 10/636,227 | 10/636,247 | 10/990,382 |
| 11/305,158 | 11/033,145 | 10/913,373 | 10/913,374 | 10/913,380 | 10/913,379 | 10/407,212 |
| 10/683,064 | 10/884,889 | 10/922,890 | 10/922,885 | 10/922,889 | 10/922,884 | 10/922,879 |
| 10/922,887 | 10/922,888 | 10/922,874 | 10/922,871 | 10/922,882 | 10/922,883 | 10/922,878 |
| 11/491,378 | 11/293,796 | 11/124,199 | 11/124,192 | 11/124,163 | 11/124,149 | 11/124,152 |
| 11/124,185 | 11/124,201 | 11/124,191 | 11/124,159 | 11/124,170 | 11/124,148 | 11/124,168 |
| 11/124,167 | 11/228,481 | 11/228,485 | 11/228,483 | 11/228,532 | 11/228,480 | 11/737,726 |
| 11/242,916 | 11/144,799 | 10/965,772 | 11/107,799 | 11/442,180 | 11/643,845 | 10/296,534 |
| 10/534,813 | 10/534,881 | 10/534,815 | 11/246,690 | 10/760,233 | 10/760,246 | 10/760,255 |
| 10/760,209 | 10/760,194 | 10/760,232 | 11/454,904 | 11/601,756 | 10/728,783 | 10/728,803 |
| 10/773,183 | 10/773,186 | 10/773,184 | 11/060,751 | 11/603,825 | 11/097,308 | 11/544,778 |
| 11/084,806 | 09/575,197 | 09/575,186 | 09/607,843 | 09/693,690 | 09/575,181 | 09/722,174 |
| 10/291,523 | 10/291,471 | 10/291,481 | 10/291,576 | 10/291,592 | 10/291,542 | 10/291,821 |
| 10/685,523 | 10/804,034 | 10/793,933 | 10/944,044 | 10/943,877 | 10/981,626 | 10/981,616 |
| 11/026,045 | 11/059,696 | 11/051,032 | 11/059,674 | 11/082,827 | 11/202,253 | 11/203,200 |
| 11/227,239 | 11,739,014 | 10/913,350 | 11/331,109 | 10/949,307 | 11/149,160 | 11/206,756 |
| 10/778,056 | 10/917,466 | 11/281,671 | 11/754,370 | 10/291,718 | 10/492,152 | 10/492,168 |
| 10/683,151 | 10/510,391 | 10/778,090 | 11/074,782 | 11/188,016 | 11/072,529 | 11/155,545 |
| 11/144,813 | 11/707,946 | 11/730,776 | 11/066,161 | 11/066,159 | 11/066,158 | 11/650,536 |
| 10/727,181 | 10/727,162 | 10/727,245 | 10/727,180 | 10/727,179 | 10/727,164 | 10/727,198 |
| 10/754,938 | 11/488,853 | 10/296,522 | 10/884,881 | 10/854,522 | 10/854,488 | 10/854,503 |
| 10/854,495 | 10/854,498 | 10/854,512 | 10/854,525 | 10/854,526 | 10/854,505 | 10/854,493 |
| 10/854,528 | 10/854,520 | 10/854,499 | 10/854,518 | 10/854,517 | 10/636,216 | 10/853,143 |
| 11/225,158 | 11/442,132 | 11/544,768 | 10/760,202 | 10/760,198 | 10/760,249 | 10/760,264 |
| 10/760,192 | 10/760,203 | 10/760,205 | 10/760,206 | 10/760,267 | 10/760,270 | 10/760,271 |
| 11/014,747 | 11/014,760 | 11/014,762 | 11/014,756 | 11/014,736 | 11/014,759 | 11/014,758 |
| 11/014,737 | 11/014,735 | 11/014,719 | 11/014,749 | 11/014,769 | 11/014,729 | 11/014,733 |
| 11/014,755 | 11/014,765 | 11/014,766 | 11/014,740 | 11/014,744 | 11/014,768 | 11/599,312 |
| 11/442,177 | 11/706,305 | 11/706,966 | 11/014,728 | 10/760,215 | 10/760,266 | 10/760,260 |
| 10/760,241 | 10/962,413 | 10/962,428 | 10/962,426 | 10/962,409 | 10/962,417 | 10/962,403 |
| 11/474,267 | 11/223,262 | 11/223,018 | 11/014,730 | 10/982,804 | 10/982,817 | 10/986,813 |
| 10/986,785 | 10/986,788 | 10/992,747 | 10/992,828 | 11/013,881 | 11/248,429 | 11/298,633 |
| 11/604,316 | 11/713,660 | 09/900,160 | 10/510,096 | 11/202,235 | 10/780,624 | 10/791,792 |
| 11/048,748 | 11/583,939 | 10/959,049 | 11/330,057 | 11/525,860 | 10/636,258 | 10/729,151 |
| 10/729,157 | 10/683,006 | 11/123,009 | 11/281,444 | 11/544,577 | 11/604,321 | 11/655,987 |
| 11/650,541 | 11/203,188 | 11/203,173 | 10/846,562 | 10/846,649 | 10/846,627 | 11/505,849 |
| 11/635,489 | 11/604,319 | 11/744,214 | 11,744,218 | 11,748,490 | 09/575,197 | 09/575,186 |

BACKGROUND OF THE INVENTION

Many different types of printing have been invented, a large number of which are presently in use. The known forms of print have a variety of methods for marking the print media with a relevant marking media. Commonly used forms of printing include offset printing, laser printing and copying devices, dot matrix type impact printers, thermal paper printers, film recorders, thermal wax printers, dye sublimation printers and ink jet printers both of the drop on demand and continuous flow type. Each type of printer has its own advantages and problems when considering cost, speed, quality, reliability, simplicity of construction and operation etc.

In recent years, the field of ink jet printing, wherein each individual pixel of ink is derived from one or more ink nozzles has become increasingly popular primarily due to its inexpensive and versatile nature.

Many different techniques on ink jet printing have been invented. For a survey of the field, reference is made to an article by J Moore, "Non-Impact Printing: Introduction and Historical Perspective", Output Hard Copy Devices, Editors R Dubeck and S Sherr, pages 207-220 (1988).

Ink Jet printers themselves come in many different types. The utilization of a continuous stream of ink in ink jet printing appears to date back to at least 1929 wherein U.S. Pat. No. 1,941,001 by Hansell discloses a simple form of continuous stream electro-static ink jet printing.

U.S. Pat. No. 3,596,275 by Sweet also discloses a process of a continuous ink jet printing including the step wherein the ink jet stream is modulated by a high frequency electro-static field so as to cause drop separation. This technique is still utilized by several manufacturers including Elmjet and Scitex (see also U.S. Pat. No. 3,373,437 by Sweet et al)

Piezoelectric ink jet printers are also one form of commonly utilized ink jet printing device. Piezoelectric systems are disclosed by Kyser et. al. in U.S. Pat. No. 3,946,398 (1970) which utilizes a diaphragm mode of operation, by Zolten in U.S. Pat. No. 3,683,212 (1970) which discloses a squeeze mode of operation of a piezoelectric crystal, Stemme in U.S. Pat. No. 3,747,120 (1972) discloses a bend mode of piezoelectric operation, Howkins in U.S. Pat. No. 4,459,601 discloses a piezoelectric push mode actuation of the ink jet stream and Fischbeck in U.S. Pat. No. 4,584,590 which discloses a shear mode type of piezoelectric transducer element.

Recently, thermal inkjet printing has become an extremely popular form of ink jet printing. The ink jet printing techniques include those disclosed by Endo et al in GB 2007162 (1979) and Vaught et al in U.S. Pat. No. 4,490,728. Both the aforementioned references disclosed ink jet printing techniques that rely upon the activation of an electrothermal actuator which results in the creation of a bubble in a constricted space, such as a nozzle, which thereby causes the ejection of ink from an aperture connected to the confined space onto a relevant print media. Printing devices utilizing the electro-thermal actuator are manufactured by manufacturers such as Canon and Hewlett Packard.

As can be seen from the foregoing, many different types of printing technologies are available. Ideally, a printing technology should have a number of desirable attributes. These include inexpensive construction and operation, high speed operation, safe and continuous long term operation etc. Each technology may have its own advantages and disadvantages in the areas of cost, speed, quality, reliability, power usage, simplicity of construction operation, durability and consumables.

Supplying ink from an ink reservoir to many thousand densely packed nozzles is a particular challenge in high-resolution pagewidth printing. One problem is avoiding ink pressure surges when a nozzle stops printing. During printing, each nozzle acts like a pump so that each nozzle chamber is refilled with ink almost instantaneously. Forming the nozzle chambers from hydrophilic materials (e.g. silicon nitride, silicon dioxide etc.) facilitates refilling of nozzle chambers during printing.

However, when printing ceases, it is equally important that ink does not flood out from nozzle openings and onto the printhead face. Flooding of this nature has a deleterious effect on print quality and may require frequent cleaning by a printhead maintenance station. Flooding is a particular problem in high-speed pagewidth printheads, where a relatively large mass of ink moves towards each nozzle of the printhead during printing. This moving mass of ink has an associated inertia, which may cause ink to continue leaking from nozzles even when printing ceases. The greater the momentum of ink in the ink supply system, the higher the risk of flooding.

To this end, pressure dampening structures have been proposed in the ink supply system, which absorb the pressure wave of ink being supplied to the nozzles. Hitherto, the Applicant has described air boxes in fluid communication with ink supply lines, which have a dampening effect on ink pressure waves. For a full discussion of ink pressure dampening, reference is made to [INSERT CROSSREF], the contents of which is herein incorporated by cross-reference. Essentially, it is desirable to allow some 'give' in the ink supply system, so that the pressure wave associated with a moving body of ink can be absorbed when printing ceases.

However, the use of air to absorb pressure surges is not wholly satisfactory. Outgassing of ink is a particular problem with air-dampening structures. Outgassing is undesirable, because air bubbles in the ink can lead to blockages in ink supply lines, and even initiate catastrophic printhead deprimming. Furthermore, air-dampening structures are usually incorporated into ink supply systems a relatively long distance upstream of the inkjet nozzles—typically in a molded ink manifolds to which a MEMS printheads is mounted. Any ink downstream of such air-dampening structures will still carry a significant momentum that will not be absorbed by the air-dampening structures. Again, this problem is exacerbated in pagewidth printheads, which carry a large volume of ink compared to traditional scanning printheads.

It would be desirable to provide improved dampening structures, which are capable of absorbing pressure surges in ink supplied to inkjet nozzles. In view of the problems of outgassing, it would desirable to avoid air dampening as a means for dampening pressure surges. It would be further desirable to minimize the mass of ink between the dampening structures and the inkjet nozzles so as to improve the efficacy of any dampening system.

SUMMARY OF THE INVENTION

In a first aspect the present invention provides an inkjet printhead comprising:

a plurality of nozzle assemblies;

a nozzle plate covering said plurality of nozzle assemblies;

an ink supply system for supplying ink to said plurality of nozzle assemblies, said ink supply system comprising at least one conduit wall defined by part of said nozzle plate; and at least one pressure-dampening structure positioned in said part of said nozzle plate, such that ink pressure fluctuations in said ink supply system are dampened by said pressure-dampening structure.

Optionally, said at least one pressure-dampening structure comprises:

a vent defined in said part of said nozzle plate; and a flexible membrane sealingly covering said vent.

Optionally, said flexible membrane has a Young's modulus of less than 1000 MPa.

Optionally, said flexible membrane is a comprised of a polymer layer.

Optionally, said polymer layer covers said nozzle plate

Optionally, said polymer layer is hydrophobic.

Optionally, said polymer layer is resistant to removal by an oxidizing plasma.

Optionally, said polymer layer is comprised of polydimethylsiloxane (PDMS).

In a further aspect the printhead comprises a plurality of said pressure-dampening structures, said polymer layer defining a plurality of flexible membranes for sealingly covering each vent.

In a further aspect the printhead comprises at least 100 pressure-dampening structures per square cm of said nozzle plate.

Optionally, a distance between said pressure-dampening structure and at least one of said nozzle assemblies is less than 100 microns.

Optionally, each nozzle assembly comprises:

a nozzle chamber having a nozzle aperture and an ink inlet defined therein, said ink inlet being in fluid communication with an ink supply channel; and an actuator for ejection of ink through said nozzle aperture.

Optionally, each nozzle chamber is formed on a surface of a printhead substrate, each nozzle chamber comprising a roof spaced apart from said substrate and sidewalls extending between said roof and said substrate, said nozzle aperture being defined in said roof and each roof defining part of the nozzle plate.

Optionally, said nozzle chambers are arranged in rows, each row of nozzle chambers having an associated ink conduit extending longitudinally adjacent said row, said ink conduit being defined between said nozzle plate and said substrate, and said ink conduit being defined at least partially by said at least one conduit wall.

Optionally, said ink conduit supplies ink to a plurality of said ink chambers via a sidewall ink inlet defined in each nozzle chamber.

Optionally, said ink conduit is shared by a pair of rows.

Optionally, said ink conduit is connected to one or more ink inlet passages, each ink inlet passage extending from said ink conduit through said substrate, and each ink inlet passage extending substantially perpendicularly with respect to said nozzle plate and said ink conduit.

Optionally, each ink inlet passage is aligned with a respective pressure-dampening structure in said nozzle plate.

Optionally, each ink inlet passage is connected to an ink supply channel defined in said substrate, said ink supply channel receiving ink from opposite side of said substrate relative to said nozzle assemblies.

In a further aspect there is provided a printhead integrated circuit comprising:

a substrate;

a plurality of nozzle assemblies formed on said substrate, each nozzle assembly having a nozzle aperture and an actuator for ejection of ink through said nozzle aperture;

drive circuitry electrically connected to each of said actuators;

a nozzle plate covering said plurality of nozzle assemblies an ink supply system for supplying ink to said plurality of nozzle assemblies, said ink supply system comprising at least one conduit wall defined by part of said nozzle plate; and at least one pressure-dampening structure positioned in said part of said nozzle plate, such that ink pressure fluctuations in said ink supply system are dampened by said pressure-dampening structure.

In a second aspect the present invention provides an inkjet printer comprising:

an inkjet printhead having a plurality of nozzles;

at least one ink reservoir;

an ink supply system for supplying ink from said at least one ink reservoir to said plurality of nozzles, said ink supply system comprising at least one pressure-dampening structure for dampening pressure fluctuations experienced by said nozzles, wherein a distance between said at least one pressure-dampening structure and at least one of said nozzles is less than 100 microns.

Optionally, the distance between said at least one pressure-dampening structure and at least one of said nozzles is less than 50 microns.

Optionally, the distance between said at least one pressure-dampening structure and at least one of said nozzles is less than 25 microns.

Optionally, said printhead comprises part of said ink supply system.

Optionally, said ink supply system comprises at least 100 pressure-dampening structures.

Optionally, said ink supply system comprises at least 500 pressure-dampening structures.

Optionally, said ink supply system comprises at least 1000 pressure-dampening structures.

Optionally, said printhead comprises:

a plurality of nozzle chambers;

a nozzle plate covering said plurality of nozzle chambers;

a printhead ink supply system for supplying ink to said plurality of nozzle chambers, said printhead ink supply system comprising at least one conduit wall defined by part of said nozzle plate; and the at least one pressure-dampening structure positioned in said part of said nozzle plate.

Optionally, the at least one pressure-dampening structure comprises:

a vent defined in said part of said nozzle plate; and a flexible membrane sealingly covering said vent.

Optionally, said flexible membrane has a Young's modulus of less than 1000 MPa.

Optionally, said flexible membrane is a comprised of a polymer layer.

Optionally, said polymer layer covers said nozzle plate

Optionally, said polymer layer is comprised of polydimethylsiloxane (PDMS).

In another aspect the inkjet printer comprises a plurality of said pressure-dampening structures, said polymer layer defining a plurality of flexible membranes for sealingly covering each vent.

Optionally, each nozzle chamber is formed on a surface of a printhead substrate, each nozzle chamber comprising a roof spaced apart from said substrate and sidewalls extending between said roof and said substrate, said roof having a nozzle aperture defined therein, and each roof defining part of said nozzle plate.

Optionally, said nozzle chambers are arranged in rows, each row of nozzle chambers having an associated ink conduit extending longitudinally adjacent said row, said ink conduit being defined between said nozzle plate and said substrate, and said ink conduit being defined at least partially by said at least one conduit wall.

Optionally, said ink conduit supplies ink to a plurality of said ink chambers via a sidewall ink inlet defined in each nozzle chamber.

Optionally, said ink conduit is connected to one or more ink inlet passages, each ink inlet passage extending from said ink conduit through said substrate, and each ink inlet passage extending substantially perpendicularly with respect to said nozzle plate and said ink conduit.

Optionally, each ink inlet passage is aligned with a respective pressure-dampening structure in said nozzle plate.

Optionally, each ink inlet passage is connected to an ink supply channel defined in said substrate, said ink supply channel receiving ink from an opposite side of said substrate relative to said nozzle chambers.

BRIEF DESCRIPTION OF THE DRAWINGS

Optional embodiments of the present invention will now be described by way of example only with reference to the accompanying drawings, in which.

DESCRIPTION OF OPTIONAL EMBODIMENTS

The present invention may be used with any type of printhead. The present Applicant has previously described a plethora of inkjet printheads. It is not necessary to describe all such printheads here for an understanding of the present invention. However, the present invention will now be described in connection with a thermal bubble-forming inkjet printhead. For the avoidance of doubt, all references herein to "ink" should be construed to mean any ejectable printing fluid and includes, for example, traditional inks, invisible inks, fixatives and other printable fluids.

Printheads Having Sidewall Nozzle Chamber Inlets

Hitherto, we have described a thermal bubble-forming inkjet printhead, in which ink is supplied to a nozzle chamber from an ink conduit via a sidewall of the nozzle chamber. Such a printhead was described, for example, in our earlier US Publication No. 2007/0081044, the contents of which is herein incorporated by reference.

Figure 1:
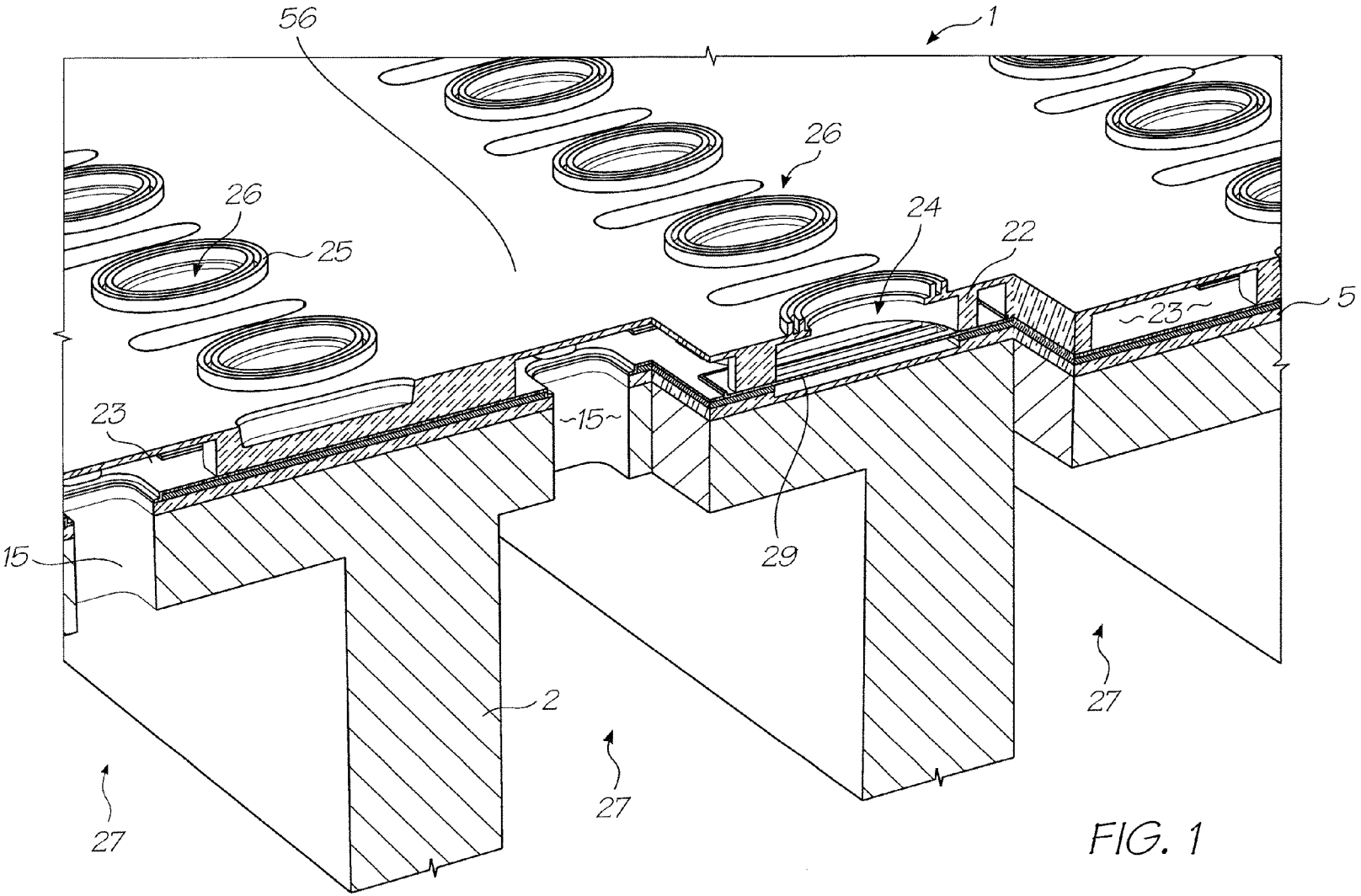
FIG. 1 is a partial perspective view of an array of nozzle assemblies with nozzle chambers having a sidewall ink inlet.
Figure 2:
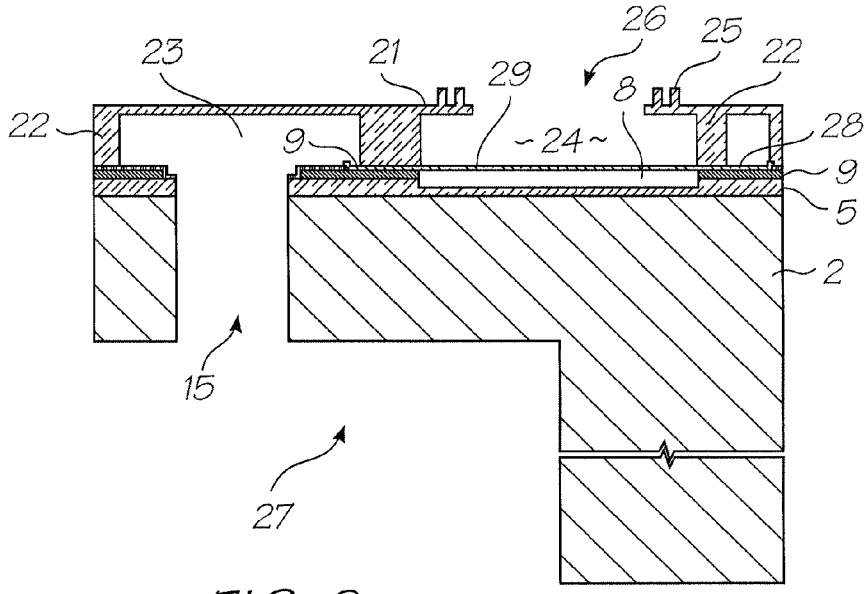
FIG. 2 is a side view of a nozzle assembly unit cell shown in FIG. 1.
Figure 3:
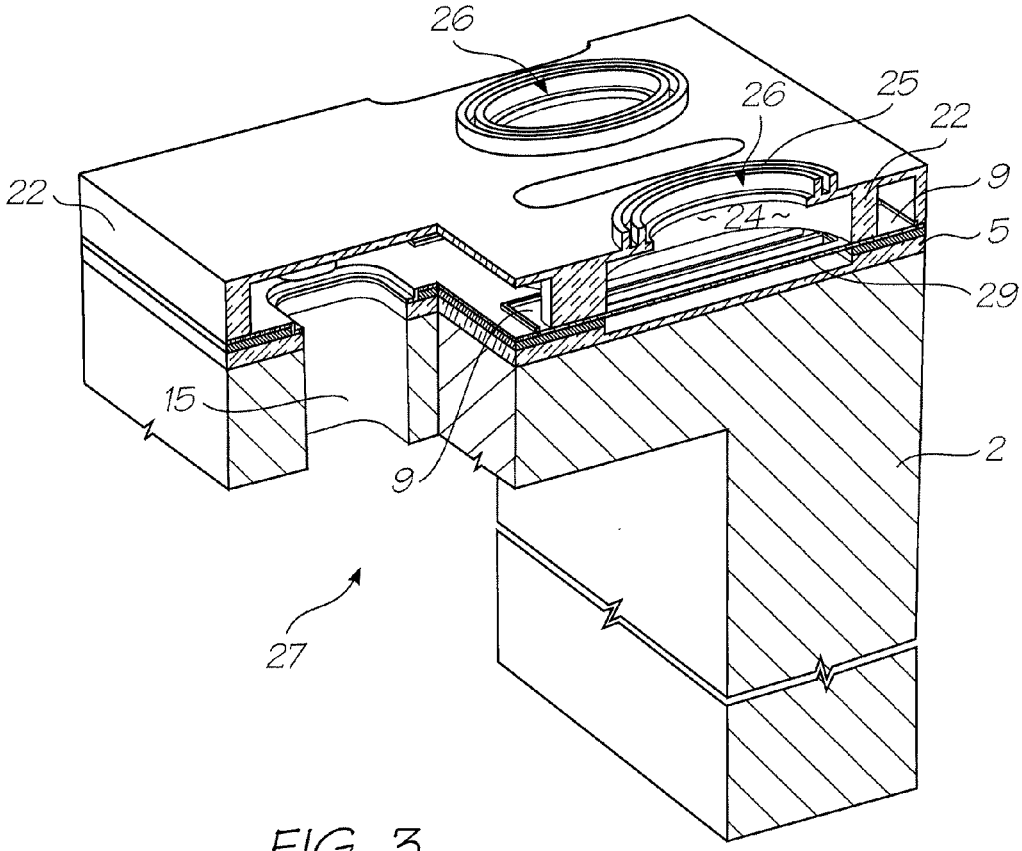
FIG. 3 is a perspective of the nozzle assembly shown in FIG. 2.

Referring to FIG. 1, there is shown part of a prior-disclosed printhead 1 comprising a plurality of nozzle assemblies. FIGS. 2 and 3 show one of these nozzle assemblies in side-section and cutaway perspective views.

Each nozzle assembly comprises a nozzle chamber 24 formed by MEMS fabrication techniques on a silicon wafer substrate 2. The nozzle chamber 24 is defined by a roof 21 and sidewalls 22 which extend from the roof 21 to the silicon substrate 2. As shown in FIG. 1, each roof is defined by part of a nozzle plate 56, which spans across an ejection face of the printhead 1. The nozzle plate 56 and sidewalls 22 are formed of the same material, which is deposited by PECVD over a sacrificial scaffold of photoresist during MEMS fabrication. Typically, the nozzle plate 56 and sidewalls 22 are formed of a ceramic material, such as silicon dioxide or silicon nitride. These hard materials have excellent properties for printhead robustness, and their inherently hydrophilic nature is advantageous for supplying ink to the nozzle chambers 24 by capillary action.

Returning to the details of the nozzle chamber 24, it will be seen that a nozzle opening 26 is defined in a roof of each nozzle chamber 24. Each nozzle opening 26 is generally elliptical and has an associated nozzle rim 25. The nozzle rim 25 assists with drop directionality during printing as well as reducing, at least to some extent, ink flooding from the nozzle opening 26. The actuator for ejecting ink from the nozzle chamber 24 is a heater element 29 positioned beneath the nozzle opening 26 and suspended across a pit 8. Current is supplied to the heater element 29 via electrodes 9 connected to drive circuitry in underlying CMOS layers 5 of the substrate 2. When a current is passed through the heater element 29, it rapidly superheats surrounding ink to form a gas bubble, which forces ink through the nozzle opening. By suspending the heater element 29, it is completely immersed in ink when the nozzle chamber 24 is primed. This improves printhead efficiency, because less heat dissipates into the underlying substrate 2 and more input energy is used to generate a bubble.

As seen most clearly in FIG. 1, the nozzles are arranged in rows and an ink supply channel 27, which extends longitudinally along the printhead, supplies ink to each nozzle in the row. Each row of nozzles has an associated ink conduit 23 extending longitudinally along the row. The ink conduit 23 is defined between the nozzle plate 56 and the substrate 2. The ink conduit 23 receives ink from the ink supply channel 27 via ink inlet passages 15, and delivers ink to individual nozzle chambers 24 via a sidewall inlet defined in a sidewall 22 of each nozzle chamber.

Hitherto, we have also described how the nozzle plate 56 of the printhead 1 may be coated with a layer of hydrophobic material, such as polydimethylsiloxane (PDMS) and perfluorinated polyethylene (PFPE). This hydrophobic exterior layer provides the printhead 1 with superior properties for printhead maintenance, as well as reducing the risk of flooding across the nozzle plate. Such a printhead and the fabrication thereof was described in detail in our earlier U.S. patent application Ser. No. 11/685,084 filed on Mar. 12, 2007, the contents of which is herein incorporated by reference. Further improvements in the manufacture of this hydrophobically-coated printhead were described in our earlier U.S. patent application Ser. No. 11/740,925 filed on Apr. 27, 2007, the contents of which is herein incorporated by cross-reference.

Printheads Incorporating Pressure-Dampening Structures

A manufacturing process for a printhead incorporating pressure-dampening structures will now be described. A partially-fabricated inkjet nozzle assembly, at the stage of fabrication shown in FIGS. 4 and 5, has been described in detail previously by the present Applicant (see US Publication No. 2007/0081044, the contents of which is herein incorporated by reference). For the sake of clarity, similar features described in connection with printhead 1 are given the same reference numerals in the following description.

Figure 4:
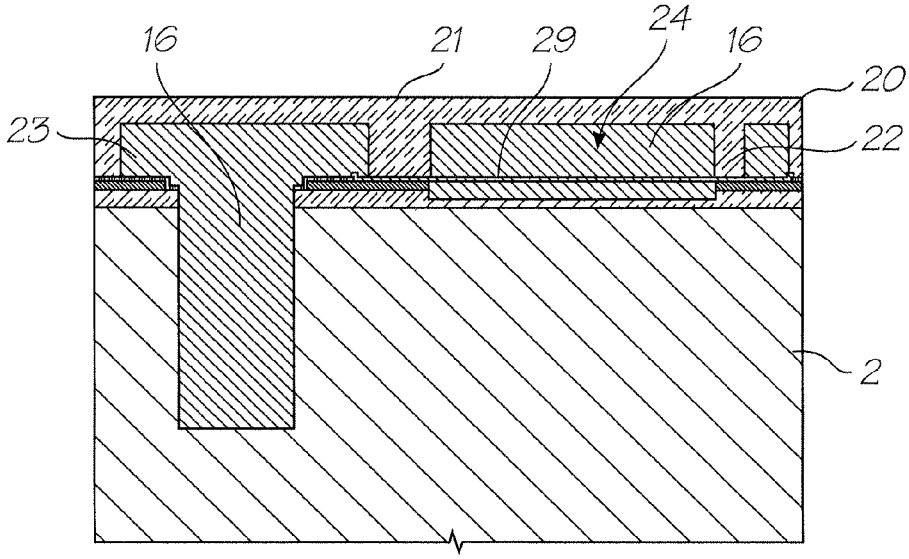
FIG. 4 is a side view of a partially-fabricated inkjet nozzle assembly immediately after deposition roof material onto a sacrificial photoresist scaffold.
Figure 5:
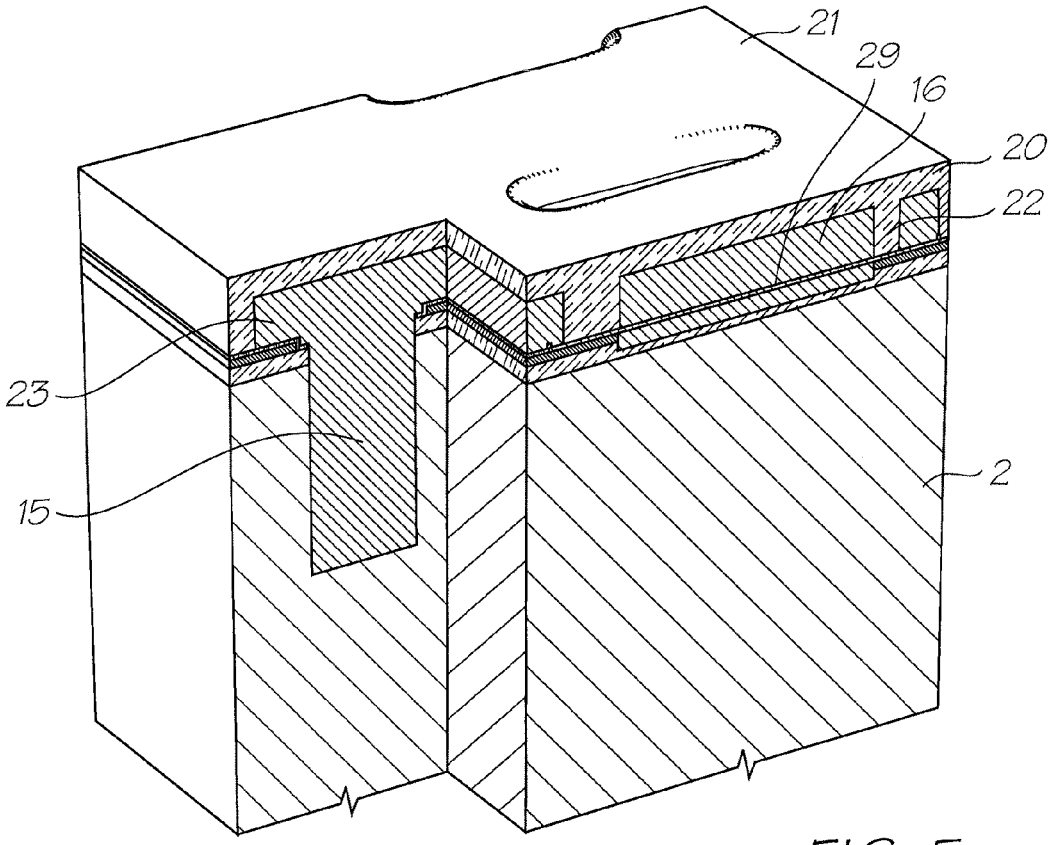
FIG. 5 is a perspective view of the nozzle assembly shown in FIG. 4.

As shown in FIGS. 4 and 5, the inkjet nozzle assembly comprises a nozzle chamber 24 and ink conduit 23 defined by a roof 21 and sidewalls 22 extending from the roof to the substrate 2. The roof 21 and sidewalls 22 are constructed by deposition of, for example, silicon nitride roof material 20 onto a sacrificial scaffold of photoresist 16. This photoresist 16 will be removed by an oxidizing plasma in a latter stage of printhead fabrication.

Figure 6:
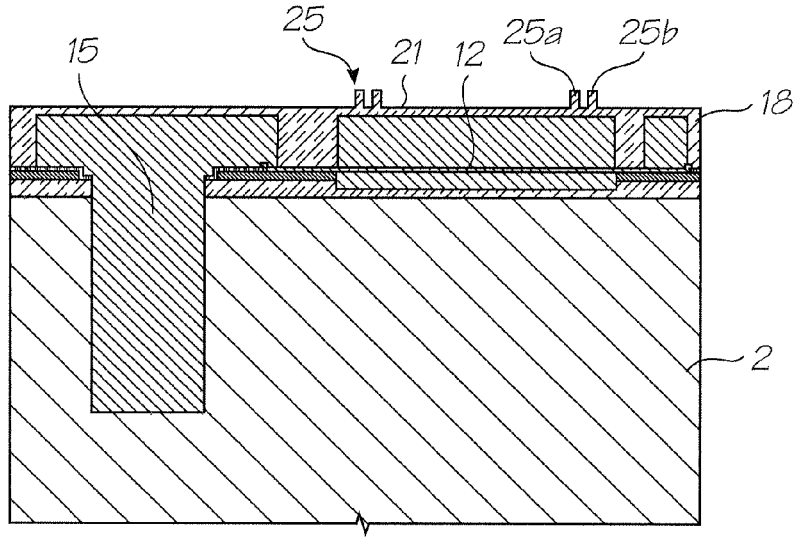
FIG. 6 is a side view of the nozzle assembly shown in FIG. 4 after a nozzle rim etch.
Figure 7:
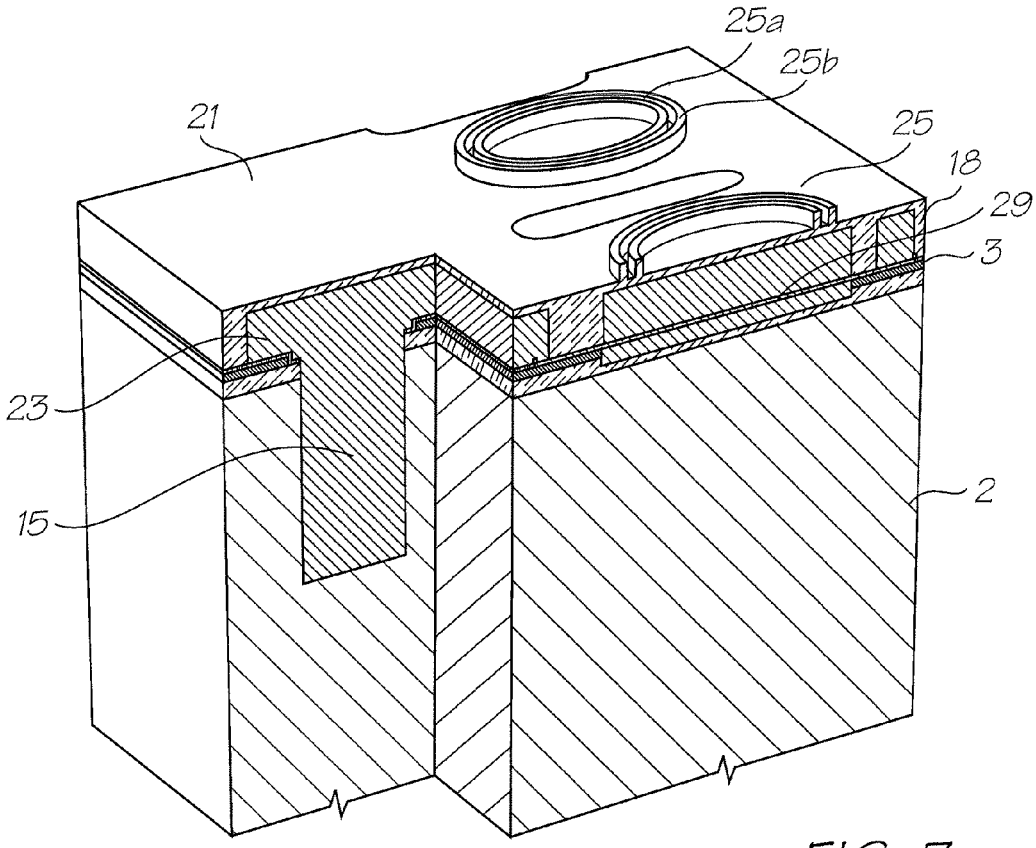
FIG. 7 is a perspective view of the nozzle assembly shown in FIG. 6.

Referring to FIGS. 6 and 7, the next stage defines an elliptical nozzle rim 25 in the roof 21 by etching away about 2 microns of roof material 20. As seen most clearly in FIG. 7, the elliptical rim 25 comprises two coaxial rim lips **25*a* and 25*b***.

Figure 8:
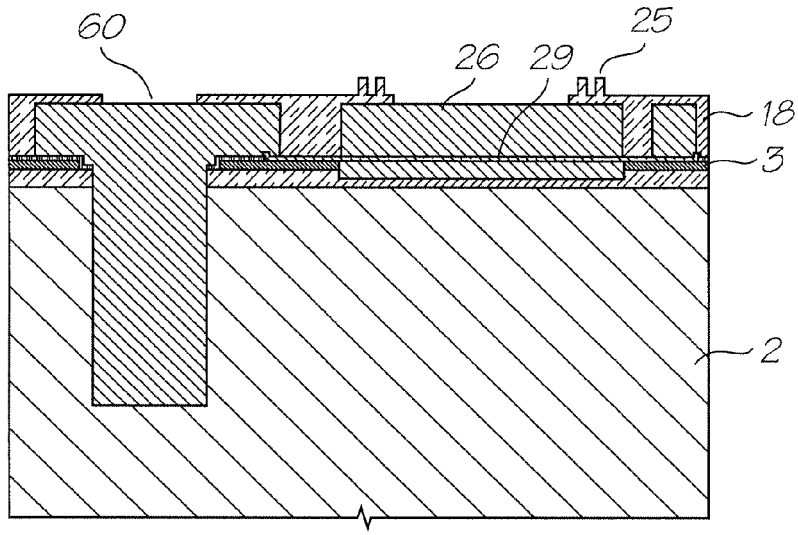
FIG. 8 is a side view of the nozzle assembly shown in FIG. 6 after a nozzle aperture and pressure vent etch.
Figure 9:
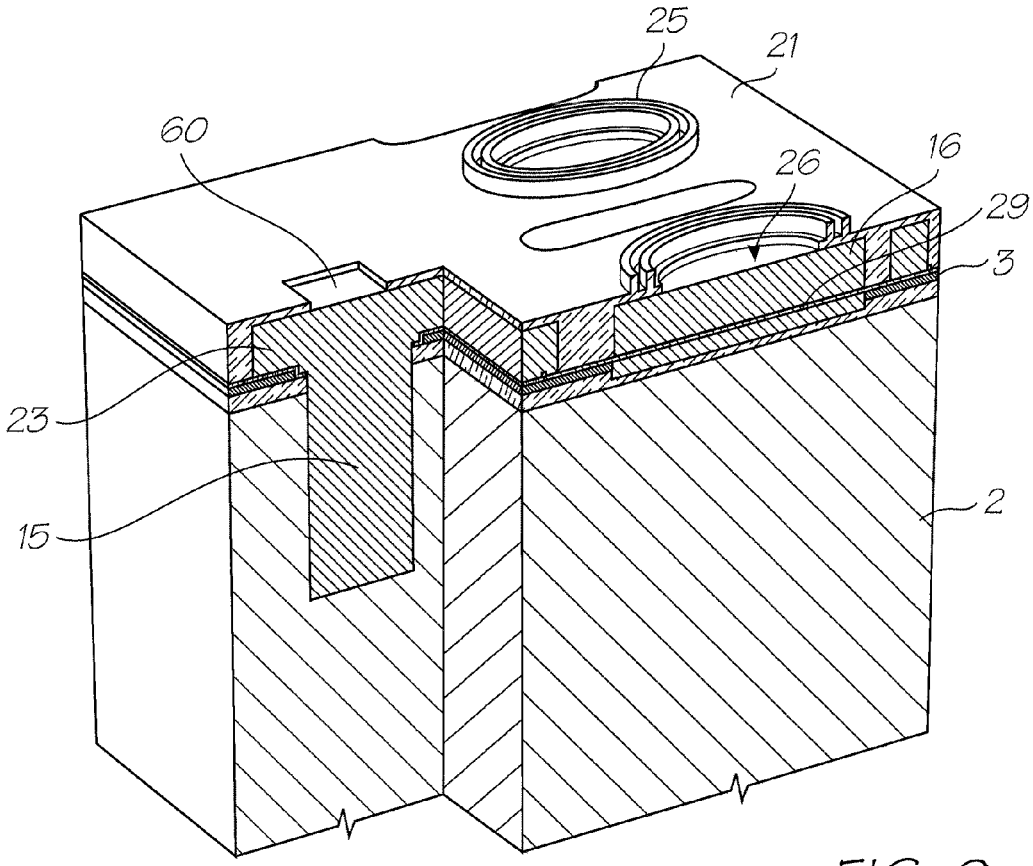
FIG. 9 is a perspective view of the nozzle assembly shown in FIG. 8.

In the process described in US Publication No. 2007/0081044, the next stage of fabrication defines an elliptical nozzle aperture 26 by etching through the remaining roof material 20 bounded by the nozzle rim 25. However, in the present invention, a vent 60 is etched simultaneously with the nozzle aperture 26. As shown in FIGS. 8 and 9, the vent 60 is defined in the roof 21 and positioned immediately above the ink inlet 15, which at this stage of fabrication is still filled with photoresist.

Figure 10:
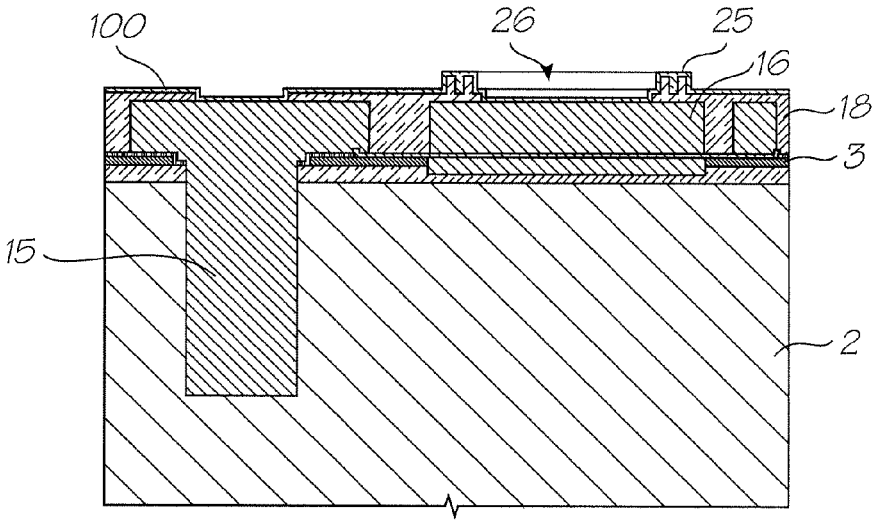
FIG. 10 is a side view of the nozzle assembly shown in FIG. 8 after deposition of a polymer layer.
Figure 11:
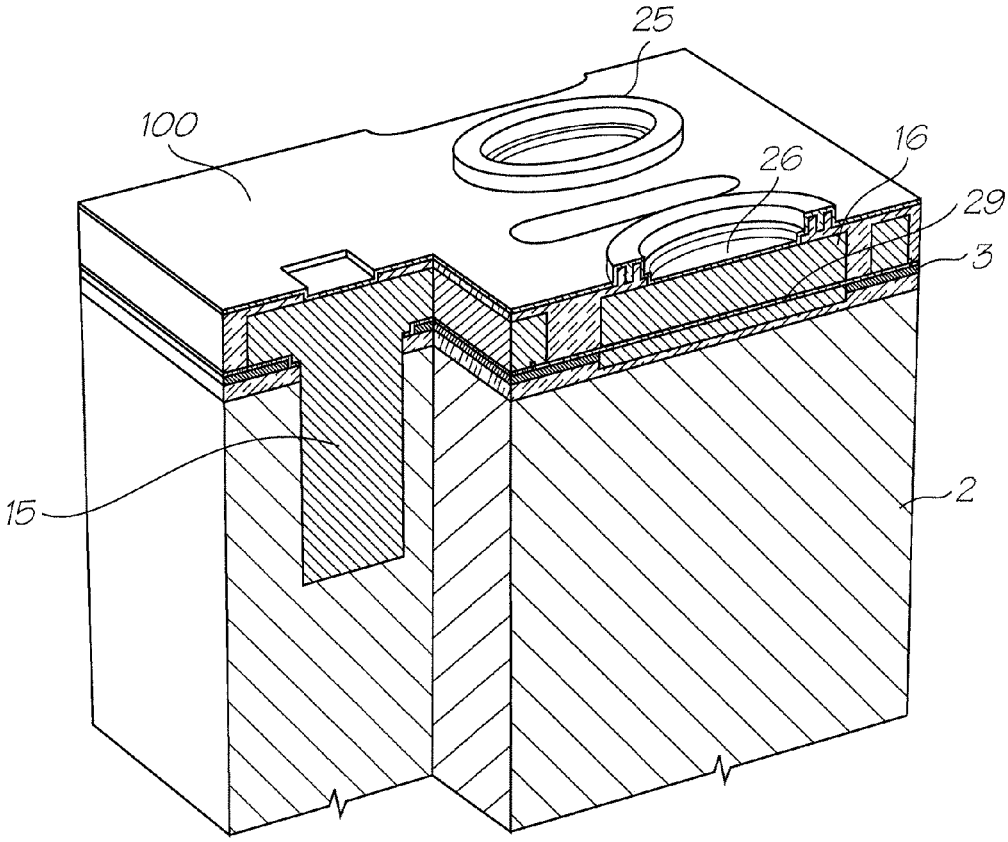
FIG. 11 is a perspective view of the nozzle assembly shown in FIG. 10.

Referring to FIGS. 10 and 11, in the next stage of fabrication, a thin layer (ca 1 micron) of polymeric material 100 is deposited over the roof 21 (and indeed the whole nozzle plate 56). The polymer 100 provides a cover for the vent 60 and also temporarily covers the nozzle aperture 26.

This polymeric material 100 may be resistant to ashing in an oxidizing plasma to facilitate late-stage ashing of the photoresist. However, as described in Applicant's U.S. application Ser. No. 11/740,925 filed on Apr. 27, 2007, any incompatibility of the polymer 100 with the ashing process may be circumvented by employing metal film protection of the polymer 100.

The polymer 100 should have some degree of flexibility or elasticity. Optionally, the polymer 100 has a relatively low stiffness. Optionally, the polymer 100 has a Young's modulus of less than 1000 MPa, and typically of the order of about 500 MPa. Optionally, the polymer 100 should also be relatively hydrophobic. The Applicant has identified a family of polymeric materials which meet the above-mentioned requirements of being hydrophobic, being resistant to ashing and having a low stiffness. These materials are typically polymerized siloxanes or fluorinated polyolefins. More specifically, polydimethylsiloxane (PDMS) and perfluorinated polyethylene (PFPE) have both been shown to be particularly advantageous. PDMS is a preferred material. A further advantage of these materials is that they have excellent adhesion to ceramics, such as silicon dioxide and silicon nitride of which the nozzle plate 56 is typically formed. A further advantage of these materials is that they are photopatternable, which makes them particularly suitable for use in a MEMS process. For example, PDMS is curable with UV light, whereby unexposed regions of PDMS can be removed relatively easily.

Figure 12:
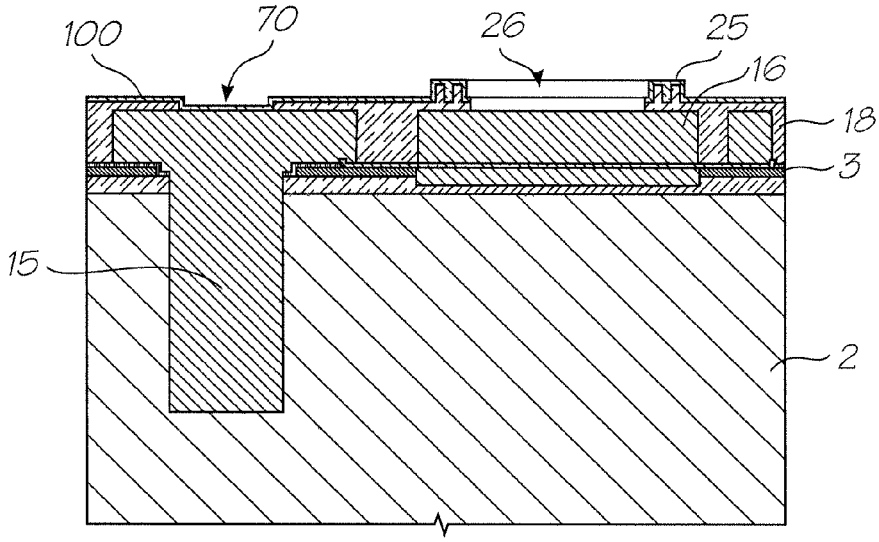
FIG. 12 is a side view of the nozzle assembly shown in FIG. 10 after photopatterning to redefine the nozzle aperture.
Figure 13:
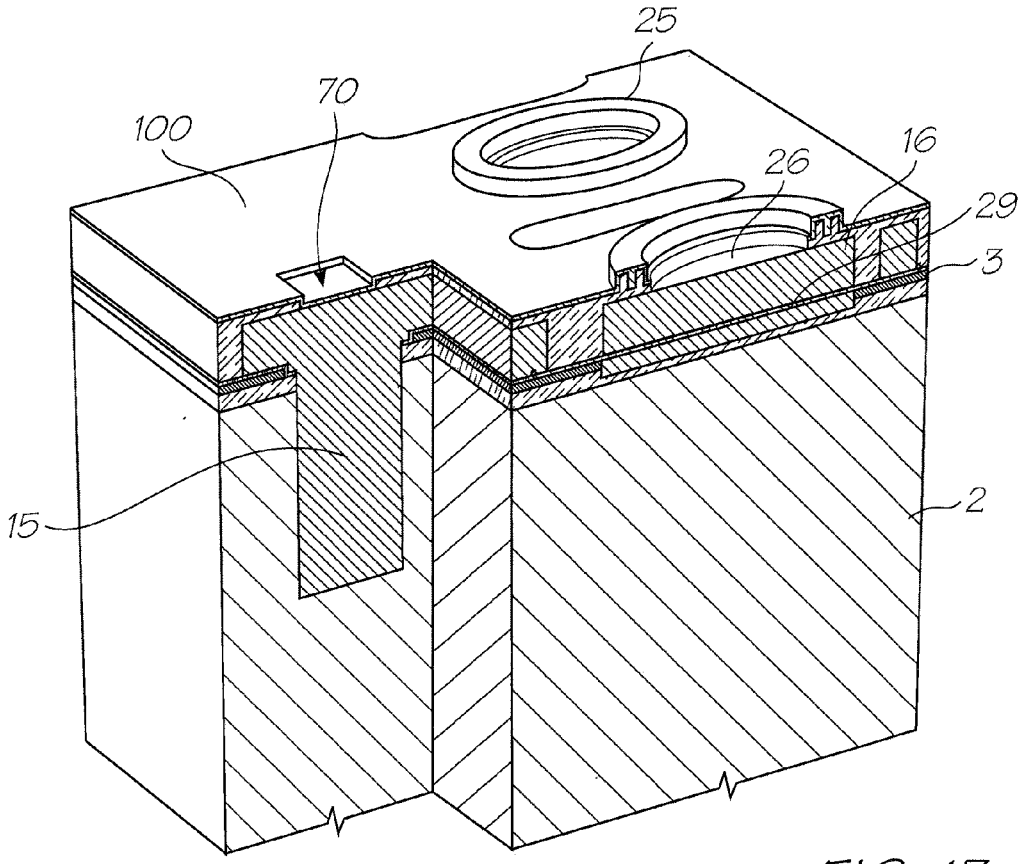
FIG. 13 is a perspective view of the nozzle assembly shown in FIG. 12.

After deposition of the polymer 100, and with reference now to FIGS. 12 and 13, the polymer layer is photopatterned so as to remove the material deposited within the nozzle aperture 26. Photopatterning may comprise exposure of the polymeric layer 100 to UV light, except for those regions within the nozzle openings 26.

Accordingly, as shown in FIGS. 12 and 13, each vent 60 is sealingly covered by an elastically deformable polymer membrane layer 100 to form a pressure-dampening structure 70 in the roof 21 above each ink inlet passage 15. Standard MEMS processing steps (back-etching of ink supply channels 27, wafer thinning and ashing of photoresist 16) then provide the printhead 200 shown in FIG. 14.

Figure 14:
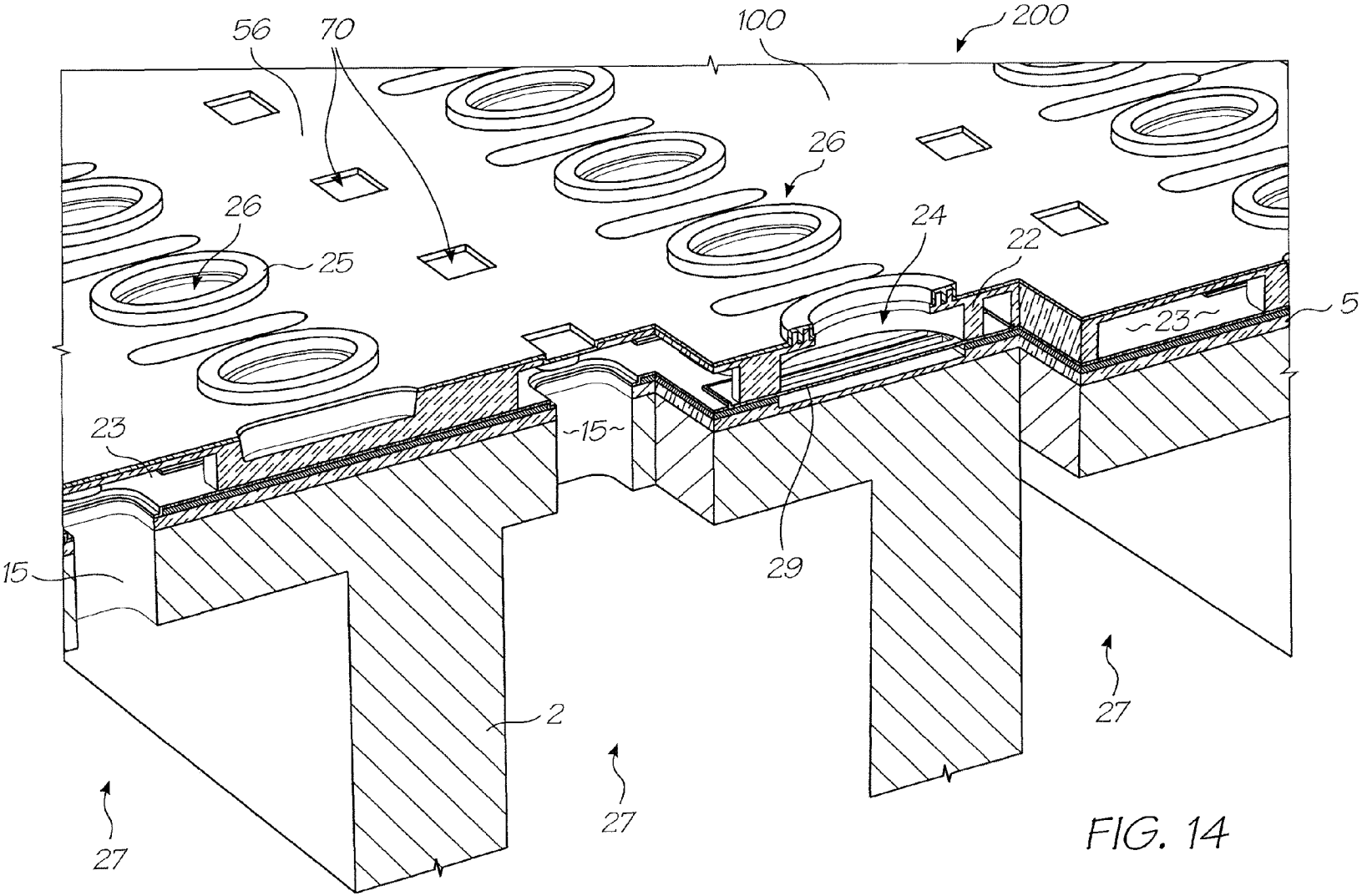
FIG. 14 is a partial perspective view of an array of the nozzle assemblies shown in FIG. 13.

The printhead 200 shown in FIG. 14 has improved ink flow characteristics, compared to the printhead 1 shown in FIG. 1, by virtue of the pressure-dampening structures 70. These structures 70 absorb pressure surges in the ink by allowing the flexible polymeric layer 100 above the vents 60 to bulge outwards during a pressure surge. Hence, the dampening structures 70 minimize the amount of ink that can flood from the nozzle apertures 26 when printing ceases. The dampening structures 70 are particularly effective when the polymer 100 has a low stiffness (e.g. a Young's modulus of less than 1000 MPa). As described above, PDMS is particularly effective in this regard.

Moreover, the dampening structures 70 are positioned adjacent each nozzle chamber 24. Optionally, each dampening structure is within less than 100 microns, optionally within less than 50 microns, or optionally within less than 25 microns of a nozzle assembly or a nozzle aperture 26. Hence, the volume of ink between the dampening structure 70 and the nozzle aperture 26 is relatively small compared to prior art dampening structures. This provides improved dampening efficacy and minimizes ink flooding due to pressure surges.

Moreover, since the dampening structures 70 are formed by the MEMS fabrication process, a large number of these structures can be provided on a single printhead. This large-scale multiplication of dampening structures 70 on the printhead improves the effectiveness of pressure dampening compared to prior art designs, where far fewer dampening structures are typically included further upstream of the nozzle chambers 24. The Applicant's pagewidth printheads typically have an areal nozzle density of at least 10,000 nozzles per square cm of printhead surface. In accordance with the present invention, printheads may have at least 100, at least 500 or at least 1000 dampening structures per square cm of printhead surface (or nozzle plate).

A further advantage of printheads according to the present invention is that they maintain all the advantages of having a hydrophobic printhead face. Moreover, the hydrophobicity of the printhead face combined with the pressure-dampening structures 70 synergistically minimize printhead face flooding. On the one hand, the pressure-dampening structures 70 minimize pressure surges experienced at the nozzle aperture 26; on the other hand, the hydrophobicity of the printhead face compared with the hydrophilic walls of the nozzle chambers 24 minimizes ink leakages from the nozzle aperture 26, even if a pressure surge reaches the nozzle aperture 26. It will be appreciated that this synergism provided by the printhead according the present invention is particularly effective in minimizing printhead face flooding.

Figure 15:
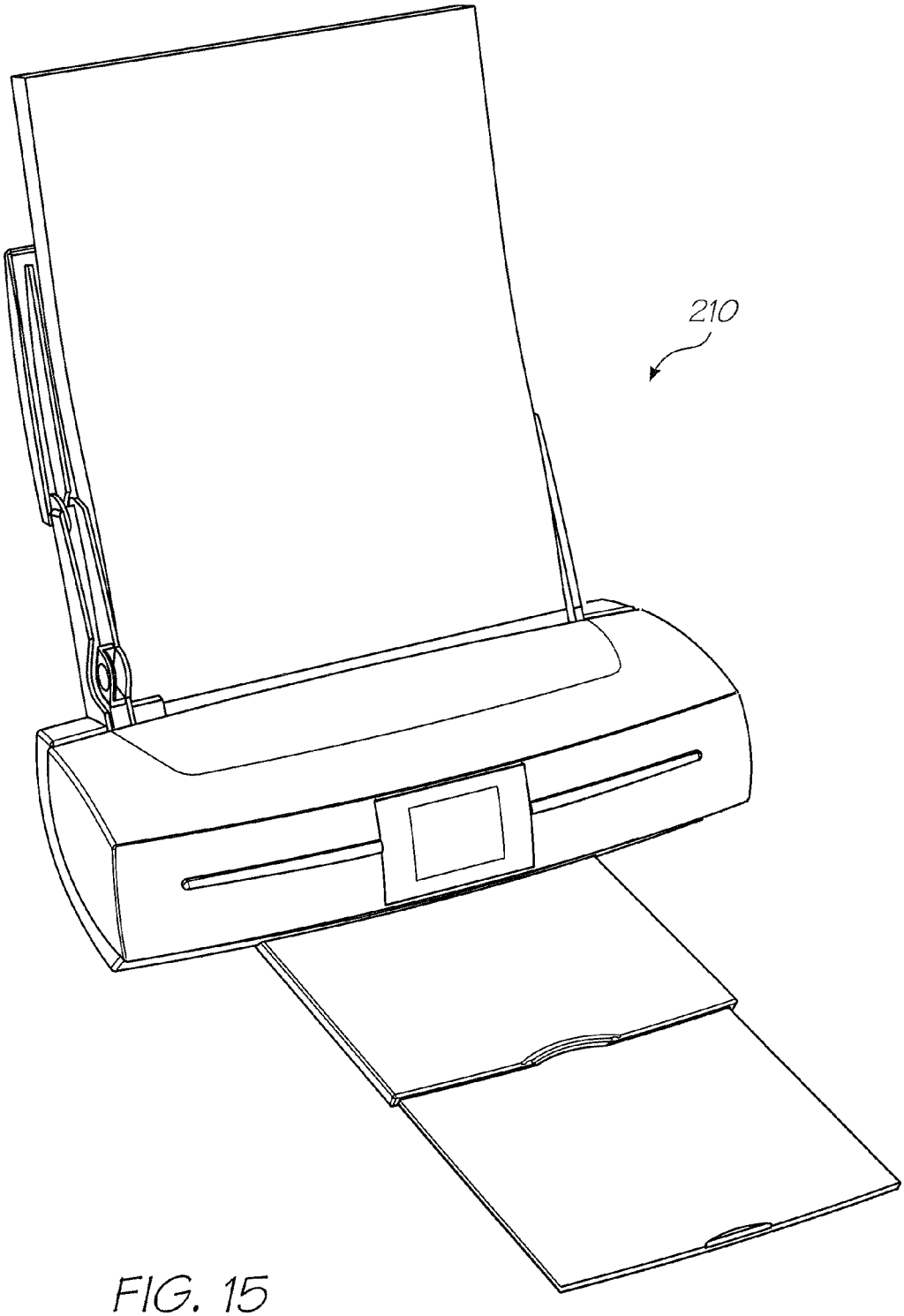
FIG. 15 is a perspective view of an inkjet printer.
Figure 16:
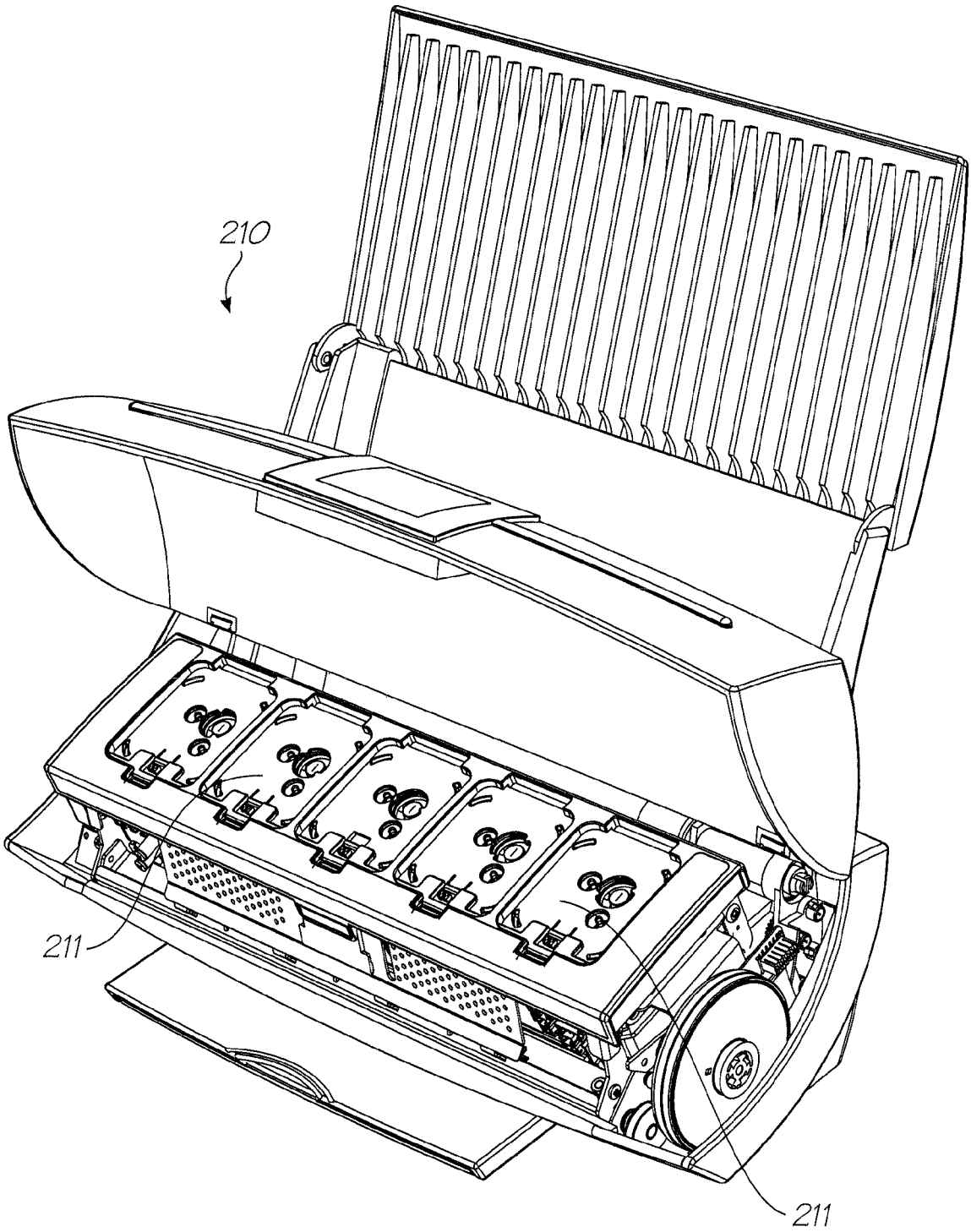
FIG. 16 is a perspective view of the inkjet printer shown in FIG. 15 with ink cartridges exposed.

Self-evidently, printheads described herein may be used in inkjet printers. FIGS. 15 and 16 show a typical pagewidth inkjet printer 210, as described in Applicant's US Publication No. 2005/0168543. The printer 210 includes a plurality of ink cartridges 211, which are in fluid communication with a printhead (not shown in FIGS. 15 and 16). Each ink cartridge 211 supplies ink to a different color channel in the printhead. A color channel typically contains one or more rows of nozzles.

It will be appreciated by ordinary workers in this field that numerous variations and/or modifications may be made to the present invention as shown in the specific embodiments without departing from the spirit or scope of the invention as broadly described. The present embodiments are, therefore, to be considered in all respects to be illustrative and not restrictive.

The invention claimed is:

1. An inkjet printhead comprising:

a plurality of nozzle assemblies;

a nozzle plate covering said plurality of nozzle assemblies;

an ink supply system for supplying ink to said plurality of nozzle assemblies, said ink supply system comprising at least one conduit wall defined by part of said nozzle plate; and at least one pressure-dampening structure comprising a vent defined in said part of said nozzle plate and a flexible membrane sealingly covering said vent, such that ink pressure fluctuations in said ink supply system are dampened by said pressure-dampening structure.

2. The printhead of claim 1, wherein said flexible membrane has a Young's modulus of less than 1000 MPa.

3. The printhead of claim 1, wherein said flexible membrane is a comprised of a polymer layer.

4. The printhead of claim 3, wherein said polymer layer covers said nozzle plate.

5. The printhead of claim 3, wherein said polymer layer is hydrophobic.

6. The printhead of claim 3, wherein said polymer layer is resistant to removal by an oxidizing plasma.

7. The printhead of claim 3, wherein said polymer layer is comprised of polydimethylsiloxane (PDMS).

8. The printhead of claim 3 comprising a plurality of said pressure-dampening structures, said polymer layer defining a plurality of flexible membranes for sealingly covering each vent.

9. The printhead of claim 1 comprising at least 100 pressure-dampening structures per square cm of said nozzle plate.

10. The printhead of claim 1, wherein a distance between said pressure-dampening structure and at least one of said nozzle assemblies is less than 100 microns.

11. The printhead of claim 1, wherein each nozzle assembly of the nozzle assemblies comprises:

a nozzle chamber having a nozzle aperture and an ink inlet defined therein, said ink inlet being in fluid communication with an ink supply channel; and an actuator for ejection of ink through said nozzle aperture.

12. The printhead of claim 11, wherein each nozzle chamber is formed on a surface of a printhead substrate, each nozzle chamber comprising a roof spaced apart from said substrate and sidewalls extending between said roof and said substrate, said nozzle aperture being defined in said roof and each roof defining part of the nozzle plate.

13. The printhead of claim 12, wherein said nozzle chambers are arranged in rows, each row of nozzle chambers having an associated ink conduit extending longitudinally adjacent said row, said ink conduit being defined between said nozzle plate and said substrate, and said ink conduit being defined at least partially by said at least one conduit wall.

14. The printhead of claim 13, wherein said ink conduit supplies ink to a plurality of said ink chambers via a sidewall ink inlet defined in each nozzle chamber.

15. The printhead of claim 13, wherein said ink conduit is shared by a pair of rows.

16. The printhead of claim 13, wherein said ink conduit is connected to one or more ink inlet passages, each ink inlet passage extending from said ink conduit through said substrate, and each ink inlet passage extending substantially perpendicularly with respect to said nozzle plate and said ink conduit.

17. The printhead of claim 16, wherein each ink inlet passage is aligned with a respective pressure-dampening structure in said nozzle plate.

18. The printhead of claim 16, wherein each ink inlet passage is connected to an ink supply channel defined in said substrate, said ink supply channel receiving ink from opposite side of said substrate relative to said nozzle assemblies.

19. A printhead integrated circuit comprising:

a substrate;

a plurality of nozzle assemblies formed on said substrate, each nozzle assembly of the plurality of nozzle assemblies having a nozzle aperture and an actuator for ejection of ink through said nozzle aperture;

drive circuity electrically connected to each of said actuators;

a nozzle plate covering said plurality of nozzle assemblies an ink supply system for supplying ink to said plurality of nozzle assemblies, said ink supply system comprising at least one conduit wall defined by part of said nozzle plate; and at least one pressure-dampening structure comprising a vent defined in said part of said nozzle plate and a flexible membrane sealingly covering said vent, such that ink pressure fluctuations in said ink supply system are dampened by said pressure-dampening structure.

* * * * *